US007354548B2

(12) United States Patent
Liu

(10) Patent No.: US 7,354,548 B2
(45) Date of Patent: Apr. 8, 2008

(54) FABRICATION OF HARDMETALS HAVING BINDERS WITH RHENIUM OR NI-BASED SUPERALLOY

(75) Inventor: Shaiw-Rong Scott Liu, Arcadia, CA (US)

(73) Assignee: Genius Metal, Inc., Monrovia, CA (US)

( * ) Notice: Subject to any disclaimer, the term of this patent is extended or adjusted under 35 U.S.C. 154(b) by 0 days.

(21) Appl. No.: 10/941,967

(22) Filed: Sep. 14, 2004

(65) Prior Publication Data

US 2008/0008616 A1 Jan. 10, 2008

Related U.S. Application Data

(62) Division of application No. 10/453,085, filed on Jun. 2, 2003, now Pat. No. 6,911,063.

(60) Provisional application No. 60/449,305, filed on Feb. 20, 2003, provisional application No. 60/439,838, filed on Jan. 13, 2003.

(51) Int. Cl.
*B22F 3/15* (2006.01)

(52) U.S. Cl. ..... 419/10; 419/49; 419/53; 419/55; 419/69

(58) Field of Classification Search ..... 419/10, 419/49, 53, 55, 69
See application file for complete search history.

(56) References Cited

U.S. PATENT DOCUMENTS

| | | | | |
|---|---|---|---|---|
| 3,409,416 | A * | 11/1968 | Yates | 428/539.5 |
| 3,916,497 | A | 11/1975 | Doi et al. | |
| 4,013,453 | A | 3/1977 | Patel | |
| 4,194,910 | A * | 3/1980 | Mal et al. | 75/236 |
| 4,249,913 | A * | 2/1981 | Johnson et al. | 51/295 |
| 4,265,662 | A | 5/1981 | Miyake et al. | |
| 4,330,333 | A | 5/1982 | Gibbs | |
| 4,432,794 | A | 2/1984 | Holleck et al. | |
| 4,639,352 | A | 1/1987 | Kodama et al. | |
| 4,735,656 | A | 4/1988 | Schaefer et al. | |
| 4,744,943 | A | 5/1988 | Timm | |
| 4,963,183 | A | 10/1990 | Hong | |
| 5,213,612 | A * | 5/1993 | Minnear et al. | 75/415 |
| 5,462,901 | A | 10/1995 | Egami et al. | |
| 5,476,531 | A | 12/1995 | Timm et al. | |
| 5,778,301 | A * | 7/1998 | Hong | 419/15 |
| 5,802,955 | A | 9/1998 | Stoll et al. | |
| 6,024,776 | A | 2/2000 | Heinrich et al. | |
| 6,368,377 | B1 | 4/2002 | Bryant et al. | |
| 6,514,456 | B1 | 2/2003 | Lackner et al. | |
| 6,663,688 | B2 * | 12/2003 | Findeisen et al. | 75/252 |
| 2002/0078794 | A1 | 6/2002 | Bredthauer et al. | |
| 2002/0194955 | A1 | 12/2002 | Fang et al. | |
| 2005/0117984 | A1 * | 6/2005 | Eason et al. | 408/144 |

FOREIGN PATENT DOCUMENTS

| | | |
|---|---|---|
| FR | 2350403 | 12/1977 |
| JP | 61201752 | 9/1986 |

OTHER PUBLICATIONS

R. Hulyal et al., Sintering of WC-10 Co Hard Metals Containing Vanadium Carbonitride and Rhenium—Part II: Rhenium Addition; Refractory Metals & Hard Materials 10 (1991) 9-13.

A.F. Lisovsky, et al.; Structure of a Binding Phase in Re-Alloyed WC—Co Cemented Carbides; Refractory metals & Hard Materials 10 (1991) 33-36.

Kenneth J, A. Brookes, World Directory and Handbook of Hardmetals and Hard Materials, 6th ed., (1996).

"Cermets and Cemented Carbides" in ASM Handbook entitled "Powder Metal Technologies and Applications," vol. 7 (1998).

TABLE I and TABLE II in the book entitled "Nickel Base Alloys" published by The International Nickel Company.

* cited by examiner

*Primary Examiner*—Roy King
*Assistant Examiner*—Ngoclan T. Mai
(74) *Attorney, Agent, or Firm*—Fish & Richardson P.C.

(57) ABSTRACT

Hardmetal compositions each including hard particles having a first material and a binder matrix having a second, different material comprising rhenium or a Ni-based superalloy. A two-step sintering process may be used to fabricate such hardmetals at relatively low sintering temperatures in the solid-state phase to produce substantially fully-densified hardmetals.

34 Claims, 8 Drawing Sheets

FABRICATION OF HARDMETALS HAVING BINDERS WITH RHENIUM OR NI-BASED SUPERALLOY

CROSS-REFERENCE TO RELATED APPLICATIONS

This application is a divisional (and claims the benefit of priority under 35 USC 120) of U.S. application Ser. No. 10/453,085, filed Jun. 2, 2003 now U.S. Pat. No. 6,911,063, which claims priority to two U.S. Provisional Applications, No. 60/439,838 entitled "Hardmetal Compositions with Novel Binder Compositions" and filed on Jan. 13, 2003, and No. 60/449,305 of the same title filed on Feb. 20, 2003. The disclosures of the above three applications are incorporated herein in their entirety as part of this application.

BACKGROUND

This application relates to hardmetal compositions, their fabrication techniques, and associated applications.

Hardmetals include various composite materials and are specially designed to be hard and refractory, and exhibit strong resistance to wear. Examples of widely-used hardmetals include sintered or cemented carbides or carbonitrides, or a combination of such materials. Some hardmetals, called cermets, have compositions that may include processed ceramic particles (e.g., TiC) bonded with binder metal particles. Certain compositions of hardmetals have been documented in the technical literature. For example, a comprehensive compilation of hardmetal compositions is published in Brookes' World Dictionary and Handbook of Hardmetals, sixth edition, International Carbide Data, United Kingdom (1996).

Hardmetals may be used in a variety of applications. Exemplary applications include cutting tools for cutting metals, stones, and other hard materials, wire-drawing dies, knives, mining tools for cutting coals and various ores and rocks, and drilling tools for oil and other drilling applications. In addition, such hardmetals also may be used to construct housing and exterior surfaces or layers for various devices to meet specific needs of the operations of the devices or the environmental conditions under which the devices operate.

Many hardmetals may be formed by first dispersing hard, refractory particles of carbides or carbonitrides in a binder matrix and then pressing and sintering the mixture. The sintering process allows the binder matrix to bind the particles and to condense the mixture to form the resulting hardmetals. The hard particles primarily contribute to the hard and refractory properties of the resulting hardmetals.

SUMMARY

The hardmetal materials described below include materials comprising hard particles having a first material, and a binder matrix having a second, different material. The hard particles are spatially dispersed in the binder matrix in a substantially uniform manner. The first material for the hard particles may include, for example, materials based on tungsten carbide, materials based on titanium carbide, and materials based on a mixture of tungsten carbide and titanium carbide. The second material for the binder matrix may include, among others, rhenium, a mixture of rhenium and cobalt, a nickel-based superalloy, a mixture of a nickel-based superalloy and rhenium, a mixture of a nickel-based superalloy, rhenium and cobalt, and these materials mixed with other materials. The nickel-based superalloy may be in the γ-γ' metallurgic phase.

In various implementations, for example, the volume of the second material may be from about 3% to about 40% of a total volume of the material. For some applications, the binder matrix may comprise rhenium in an amount at or greater than 25% of a total weight of the binder matrix in the material. In other applications, the second material may include a Ni-based superalloy. The Ni-based superalloy may include Ni and other elements such as Re for certain applications.

Fabrication of the hardmetal materials of this application may be carried out by, according to one implementation, sintering the material mixture under a vacuum condition and performing a solid-phase sintering under a pressure applied through a gas medium.

Advantages arising from these hardmetal materials and composition methods may include one or more of the following: superior hardness in general, enhanced hardness at high temperatures, and improved resistance to corrosion and oxidation.

The following are examples of various specific implementations described in this application.

1. A material comprising:

hard particles having a first material; and a binder matrix having a second, different material, a volume of said second material being from about 3% to about 40% of a total volume of the material, said binder matrix comprising rhenium in an amount greater than 25% of a total weight of the material, wherein said hard particles are spatially dispersed in said binder matrix in a substantially uniform manner.

2. The material as in the above item number 1, wherein said first material includes a carbide comprising tungsten.

3. The material as in the above item number 2, wherein said carbide comprises mono tungsten carbide (WC).

4. The material as in the above item number 2, wherein said first material further includes another carbide having a metal element different from tungsten.

5. The material as in the above item number 4, wherein said metal element is titanium (Ti).

6. The material as in the above item number 4, wherein said metal element is tantalum (Ta).

7. The material as in the above item number 4, wherein said metal element is niobium (Nb).

8. The material as in the above item number 4, wherein said metal element is vanadium (V).

9. The material as in the above item number 4, wherein said metal element is chromium (Cr).

10. The material as in the above item number 4, wherein said metal element is hafnium (Hf).

11. The material as in the above item number 4, wherein said metal element is molybdenum (Mo).

12. The material as in the above item number 2, wherein said first material further includes a nitride.

13. The material as in the above item number 12, wherein said nitride includes TiN or HfN.

14. The material as in the above item number 1, wherein said first material further includes a nitride.

15. The material as in the above item number 14, wherein said nitride includes TiN or HfN.

16. The material as in the above item number 1, wherein said binder matrix further includes cobalt (Co).

17. The material as in the above item number 1, wherein said binder matrix further includes nickel (Ni).

18. The material as in the above item number 1, wherein said binder matrix further includes molybdenum (Mo).

19. The material as in the above item number 1, wherein said binder matrix further includes iron (Fe).

20. The material as in the above item number 1, wherein said binder matrix further includes chromium (Cr).

21. The material as in the above item number 1, wherein said binder material further includes a Ni-based superalloy.

22. The material as in the above item number 21, wherein said binder material further includes cobalt.

23. A material comprising:

hard particles having a first material having a mixture selected from at least one from a group consisting of (1) a mixture of WC, TiC, and TaC, (2) a mixture of WC, TiC, and NbC, (3) a mixture of WC, TiC, and at least one of TaC and NbC, and (4) a mixture of WC, TiC, and at least one of HfC and NbC; and a binder matrix having a second, different material, a volume of said binder matrix being from about 3% to about 40% of a total volume of the material, said binder matrix comprising rhenium, wherein said hard particles are spatially dispersed in said binder matrix in a substantially uniform manner.

24. The material as in the above item number 23, where said binder matrix further includes a Ni-based superalloy.

25. A material comprising:

hard particles having a first material having a mixture of $MO_2C$ and TiC; and a binder matrix having a second, different material, a volume of said binder matrix being from about 3% to about 40% of a total volume of the material, said binder matrix comprising rhenium, wherein said hard particles are spatially dispersed in said binder matrix in a substantially uniform manner.

26. The material as in the above item number 25, wherein said first material further includes TiN.

27. The material as in the above item number 25, where said binder matrix further includes a Ni-based superalloy.

28. A method comprising:

forming a grade powder by mixing a powder of hard particles with a binder matrix material comprising rhenium;

processing the grade powder to use the binder matrix material to bind the hard particles to produce a solid hardmetal material, wherein the processing includes (1) sintering the grade powder in a solid phase under a vacuum condition, and (2) sintering the grade power in a solid phase under a pressure in an inert gas medium.

29. The method as in the above item number 28, wherein the binder matrix material further includes a Ni-based superalloy.

30. The method as in the above item number 29, wherein the binder matrix material further includes cobalt.

31. The method as in the above item number 28, wherein the binder matrix material further includes cobalt.

32. The method as in the above item number 28, wherein each sintering is performed a temperature below an eutectic temperature of the hard particles and the binder matrix material.

33. A material comprising:

hard particles having a first material; and a binder matrix having a second, different material comprising a nickel-based superalloy, wherein said hard particles are spatially dispersed in said binder matrix in a substantially uniform manner.

34. The material as in the above item number 33, wherein said first material includes a carbide comprising tungsten.

35. The material as in the above item number 34, wherein said carbide comprises mono tungsten carbide (WC).

36. The material as in the above item number 34, wherein said first material further includes another carbide having a metal element different from tungsten.

37. The material as in the above item number 36, wherein said metal element is titanium (Ti).

38. The material as in the above item number 36, wherein said metal element is tantalum (Ta).

39. The material as in the above item number 36, wherein said metal element is niobium (Nb).

40. The material as in the above item number 36, wherein said metal element is vanadium (V).

41. The material as in the above item number 36, wherein said metal element is chromium (Cr).

42. The material as in the above item number 36, wherein said metal element is hafnium (Hf).

43. The material as in the above item number 36, wherein said metal element is molybdenum (Mo).

44. The material as in the above item number 34, wherein said first material further includes a nitride.

45. The material as in the above item number 44, wherein said nitride includes TiN.

46. The material as in the above item number 44, wherein said nitride includes HfN.

47. The material as in the above item number 33, wherein said first material further includes a nitride.

48. The material as in the above item number 47, wherein said nitride includes at least one of TiN and HfN.

49. The material as in the above item number 33, wherein said nickel-based superalloy comprises primarily nickel and also comprises other elements.

50. The material as in the above item number 49, wherein said other elements include Co, Cr, Al, Ti, Mo, Nb, W, and Zr.

51. The material as in the above item number 33, wherein said binder matrix further comprises a second, different nickel-based superalloy.

52. The material as in the above item number 51, wherein said binder matrix further comprises rhenium.

53. The material as in the above item number 52, wherein said binder matrix further comprises cobalt.

54. The material as in the above item number 33, wherein said binder matrix further comprises rhenium.

55. The material as in the above item number 54, wherein said binder matrix further comprises cobalt.

56. The material as in the above item number 33, wherein said binder matrix further comprises cobalt.

57. The material as in the above item number 33, wherein said binder matrix further comprises nickel.

58. The material as in the above item number 33, wherein said binder matrix further comprises iron.

59. The material as in the above item number 33, wherein said binder matrix further comprises molybdenum.

60. The material as in the above item number 33, wherein said binder matrix further comprises chromium.

61. The material as in the above item number 33, wherein said binder matrix further comprises another alloy that is not a nickel-based alloy.

62. A material, comprising:

hard particles having a first material comprising TiC and TiN; and a binder matrix having a second, different material comprising at least one of Ni, Mo, and $MO_2C$, wherein said hard particles are spatially dispersed in said binder matrix in a substantially uniform manner.

63. The material as in the above item number 62, wherein said binder matrix further includes Re.

64. The material as in the above item number 63, wherein said binder matrix further includes Co.

65. The material as in the above item number 64, wherein said binder matrix further includes a Ni-based superalloy.

66. The material as in the above item number 63, wherein said binder matrix further includes a Ni-based superalloy.

67. The material as in the above item number 62, wherein said binder matrix further includes a Ni-based superalloy.

68. A method comprising:

forming a grade powder by mixing a powder of hard particles with a binder matrix material comprising a nickel-based superalloy;

processing the grade powder to produce a solid hardmetal material by using the binder matrix material to bind the hard particles.

69. The method as in the above item number 68, wherein said processing includes sequentially performing a pressing operation, a first sintering operation, a shaping operation, and a second sintering operation.

70. The method as in the above item number 68, further comprising: prior to the mixing, preparing the binder matrix material to further include rhenium.

71. The method as in the above item number 68, further comprising: prior to the mixing, preparing the binder matrix material to further include cobalt.

72. The method as in the above item number 68, wherein the processing includes a solid phase sintering in a hot isostatic pressing process.

73. The method as in the above item number 68, wherein the processing includes (1) sintering the grade powder in a solid phase under a vacuum condition, and (2) sintering the grade power in a solid phase under a pressure in an inert gas medium.

74. The method as in the above item number 68, further comprising: prior to the mixing, preparing the hard particles with a particle dimension less than 0.5 micron to reduce a temperature of the sintering operations.

75. A device, comprising a wear part that removes material from an object, said wear part having a material which comprises:

hard particles having a first material; and a binder matrix having a second, different material comprising rhenium and a Ni-based supper alloy, wherein said hard particles are spatially dispersed in said binder matrix in a substantially uniform manner.

76. The device as in the above item number 75, wherein said binder matrix further includes a cobalt.

77. A device, comprising a wear part having a material which comprises:

hard particles having a first material; and a binder matrix of a second, different material comprising a nickel-based superalloy, wherein said hard particles are spatially dispersed in said binder matrix in a substantially uniform manner.

78. A material comprising:

hard particles having a first material selected from at least one from a group consisting of (1) a solid solution of WC, TiC, and TaC, (2) a solid solution of WC, TiC, and NbC, (3) a solid solution of WC, TiC, and at least one of TaC and NbC, and (4) a solid solution of WC, TiC, and at least one of HfC and NbC; and a binder matrix having a second, different material, a volume of said binder matrix being from about 3% to about 40% of a total volume of the material, said binder matrix comprising rhenium, wherein said hard particles are spatially dispersed in said binder matrix in a substantially uniform manner.

79. The material as in the above item number 78, wherein the hard particles comprise a solid solution of WC, TiC, and TaC, the binder matrix is formed of pure Re.

80. The material as in the above item number 79, wherein the solid solution is about 72% of the material and the Re is about 28% of the total weight of the material.

81. The material as in the above item number 79, wherein the solid solution is about 85% of the material and the Re is about 15% of the total weight of the material.

83. The material as in the above item number 79, wherein TiC and TaC are approximately equal in quantity and have a total quantity less than a quantity of the WC.

84. The material as in the above item number 78, wherein the hard particles comprise a solid solution of WC, TiC, and TaC, the binder mat comprise Re and a Ni-superalloy.

85. The material as in the above item number 84, wherein each of TiC and Tac is from about 3% to less than about 6% in a total weight of the material, and WC is above 78% and below 89% in the total weight of the material.

86. The material as in the above item number 84, wherein the binder matrix further includes Co.

87. The material as in the above item number 84, wherein the Ni-based superalloy comprises mainly Ni and other elements including Co, Cr, Al, Ti, Mo, Nb, W, Zr, B, C, and V.

88. The material as in the above item number 78, wherein the binder matrix includes Re and a Ni-based superalloy which includes Re.

89. The material as in the above item number 21, wherein said Ni-based superalloy includes Re.

90. The material as in the above item number 24, wherein said Ni-based superalloy includes Re.

91. The material as in the above item number 21, wherein said Ni-based superalloy includes Re.

92. The material as in the above item number 33, wherein said Ni-based superalloy includes Re.

93. The material as in the above item number 33, wherein said Ni-based superalloy is in a $\gamma$-$\gamma'$ phase.

95. The material as in the above item number 50, wherein said other elements further includes Re.

These and other features, implementations, and advantages are now described in detail with respect to the drawings, the detailed description, and the claims.

DRAWING DESCRIPTION

DETAILED DESCRIPTION

Figure 1:
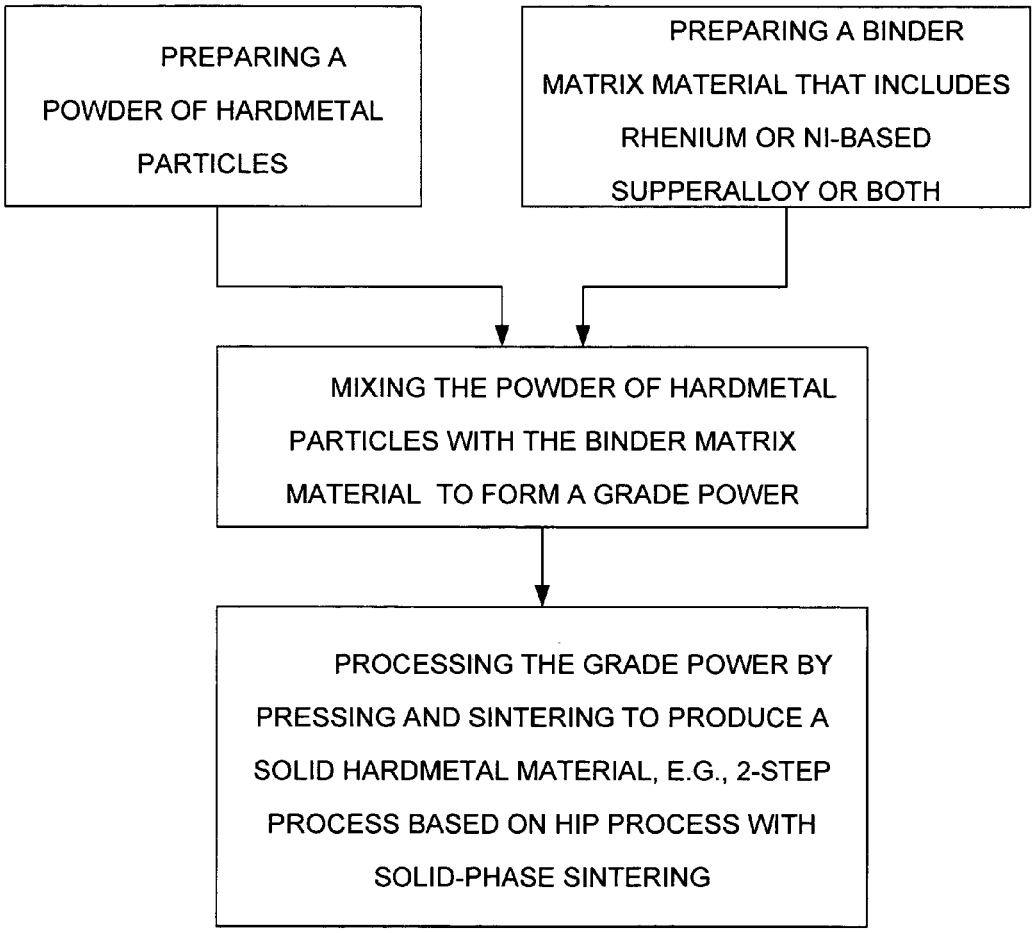
FIG. 1 shows one exemplary fabrication flow in making a hardmetal according to one implementation.

Compositions of hardmetals are important in that they directly affect the technical performance of the hardmetals in their intended applications, and processing conditions and equipment used during fabrication of such hardmetals. The hardmetal compositions also can directly affect the cost of the raw materials for the hardmetals, and the costs associated with the fabrication processes. For these and other reasons, extensive efforts have been made in the hardmetal industry to develop technically superior and economically feasible compositions for hardmetals. This application describes, among other features, material compositions for hardmetals with selected binder matrix materials that, together, provide performance advantages.

Material compositions for hardmetals of interest include various hard particles and various binder matrix materials. In general, the hard particles may be formed from carbides of the metals in columns IVB (e.g., TiC, ZrC, HfC), VB (e.g., VC, NbC, TaC), and VIB (e.g., $Cr_3C_2$, $MO_2C$, WC) in the Periodic Table of Elements. In addition, nitrides formed by metals elements in columns IVB (e.g., TiN, ZrN, HfN) and VB (e.g., VN, NbN, and TaN) in the Periodic Table of Elements may also be used. For example, one material composition for hard particles that is widely used for many hardmetals is a tungsten carbide, e.g., the mono tungsten carbide (WC). Various nitrides may be mixed with carbides to form the hard particles. Two or more of the above and other carbides and nitrides may be combined to form WC-based hardmetals or WC-free hardmetals. Examples of mixtures of different carbides include but are not limited to a mixture of WC and TiC, and a mixture of WC, TiC, and TaC.

The material composition of the binder matrix, in addition to providing a matrix for bonding the hard particles together, can significantly affect the hard and refractory properties of the resulting hardmetals. In general, the binder matrix may include one or more transition metals in the eighth column of the Periodic Table of Elements, such as cobalt (Co), nickel (Ni), and iron (Fe), and the metals in the 6B column such as molybdenum (Mo) and chromium (Cr). Two or more of such and other binder metals may be mixed together to form desired binder matrices for bonding suitable hard particles. Some binder matrices, for example, use combinations of Co, Ni, and Mo with different relative weights.

The hardmetal compositions described here were in part developed based on a recognition that the material composition of the binder matrix may be specially configured and tailored to provide high-performance hardmetals to meet specific needs of various applications. In particular, the material composition of the binder matrix has significant effects on other material properties of the resulting hardmetals, such as the elasticity, the rigidity, and the strength parameters (including the transverse rupture strength, the tensile strength, and the impact strength). Hence, the inventor recognized that it was desirable to provide the proper material composition for the binder matrix to better match the material composition of the hard particles and other components of the hardmetals in order to enhance the material properties and the performance of the resulting hardmetals.

More specifically, these hardmetal compositions use binder matrices that include rhenium, a nickel-based or a combination of at least one nickel-based superalloy and other binder materials. Other suitable binder materials may include, among others, rhenium (Re) or cobalt. A Ni-based superalloy exhibits a high material strength at a relatively high temperature. The resulting hardmetal formed with such a binder material can benefit from the high material strength at high temperatures of rhenium and Ni-superalloy and exhibit enhanced performance at high temperatures. In addition, a Ni-based superalloy also exhibits superior resistance to corrosion and oxidation, and thus, when used as a binder material, can improve the corresponding resistance of the hardmetals.

The compositions of the hardmetals described in this application may include the binder matrix material from about 3% to about 40% by volume of the total materials in the hardmetals so that the corresponding volume percentage of the hard particles is about from 97% to about 60%, respectively. Within the above volume percentage range, the binder matrix material in certain implementations may be from about 4% to about 35% by volume out of the volume of the total hardmetal materials. More preferably, some compositions of the hardmetals may have from about 5% to about 30% of the binder matrix material by volume out of the volume of the total hardmetal materials. The weight percentage of the binder matrix material in the total weight of the resulting hardmetals may be derived from the specific compositions of the hardmetals.

In various implementations, the binder matrices may be formed primarily by a nickel-based superalloy, and by various combinations of the nickel-based superalloy with other elements such as Re, Co, Ni, Fe, Mo, and Cr. A Ni-based superalloy of interest may comprise, in addition to Ni, elements Co, Cr, Al, Ti, Mo, W, and other elements such as Ta, Nb, B, Zr and C. For example, Ni-based superalloys may include the following constituent metals in weight percentage of the total weight of the superalloy: Ni from about 30% to about 70%, Cr from about 10% to about 30%, Co from about 0% to about 25%, a total of Al and Ti from about 4% to about 12%, Mo from about 0% to about 10%, W from about 0% to about 10%, Ta from about 0% to about 10%, Nb from about 0% to about 5%, and Hf from about 0% to about 5%. Ni-based superalloys may also include either or both of Re and Hf, e.g., Re from 0% to about 10%, and Hf from 0% to about 5%. Ni-based superalloy with Re may be used in applications under high temperatures. A Ni-based supper alloy may further include other elements, such as B, Zr, and C, in small amounts.

TaC and NbC have similar properties to a certain extent and may be used to partially or completely substitute or replace each other in hardmetal compositions in some implementations. Either one or both of HfC and NbC also may be used to substitute or replace a part or all of TaC in hardmetal designs. WC, TiC, TaC may be produced individually in a form of a mixture together or may be produced in a form of a solid solution. When a mixture is used, the mixture may be selected from at least one from a group consisting of (1) a mixture of WC, TiC, and TaC, (2) a mixture of WC, TiC, and NbC, (3) a mixture of WC, TiC, and at least one of TaC and NbC, and (4) a mixture of WC, TiC, and at least one of HfC and NbC. A solid solution of multiple carbides may exhibit better properties and performances than a mixture of several carbides. Hence, hard particles may be selected from at least one from a group consisting of (1) a solid solution of WC, TiC, and TaC, (2) a solid solution of WC, TiC, and NbC, (3) a solid solution of WC, TiC, and at least one of TaC and NbC, and (4) a solid solution of WC, TiC, and at least one of HfC and NbC.

The nickel-based superalloy as a binder material may be in a γ-γ' phase where the γ' phase with a FCC structure mixes with the γ phase. The strength increases with temperature within a certain extent. Another desirable property of such a Ni-based superalloy is its high resistance to oxidation and corrosion. The nickel-based superalloy may be used to either partially or entirely replace Co in various Co-based binder compositions. As demonstrated by examples disclosed in this application, the inclusion of both of rhenium and a nickel-based superalloy in a binder matrix of a hardmetal can significantly improve the performance of the resulting hardmetal by benefiting from the superior performance at high temperatures from presence of Re while utilizing the relatively low-sintering temperature of the Ni-based superalloy to maintain a reasonably low sintering temperature for ease of fabrication. In addition, the relatively low content of Re in such binder compositions allows for reduced cost of the binder materials so that such materials be economically feasible.

Such a nickel-based superalloy may have a percentage weight from several percent to 100% with respect to the total weight of all material components in the binder matrix based on the specific composition of the binder matrix. A typical nickel-based superalloy may primarily comprise nickel and other metal components in a γ-γ' phase strengthened state so that it exhibits an enhanced strength which increases as temperature rises.

Various nickel-based superalloys may have a melting point lower than the common binder material cobalt, such as alloys under the trade names Rene-95, Udimet-700, Udimet-720 from Special Metals which comprise primarily Ni in combination with Co, Cr, Al, Ti, Mo, Nb, W, B, and Zr. Hence, using such a nickel-based superalloy alone as a binder material may not increase the melting point of the resulting hardmetals in comparison with hardmetals using binders with Co.

However, in one implementation, the nickel-based superalloy can be used in the binder to provide a high material strength and to improve the material hardness of the resulting hardmetals, at high temperatures near or above 500° C. Tests of some fabricated samples have demonstrated that the material hardness and strength for hardmetals with a Ni-based superalloy in the binder can improve significantly, e.g., by at least 10%, at low operating temperatures in comparison with similar material compositions without Ni-based superalloy in the binder. The following table show measured hardness parameters of samples P65 and P46A with Ni-based superalloy in the binder in comparison with samples P49 and P47A with pure Co as the binder, where the compositions of the samples are listed in Table 4.

Effects of Ni-based Superalloy (NS) in Binder

| Sample Code Name | Co or NS Binder | Hv at Room Temperature ($Kg/mm^2$) | Ksc at room temperature ($\times 10^6$ $Pa \cdot m^{1/2}$) | Comparison |
|---|---|---|---|---|
| P49 | Co: 10 volume % | 2186 | 6.5 | |
| P65 | NS: 10 volume % | 2532 | 6.7 | Hv is about 16% greater than that of P49 |
| P47A | Co: 15 volume % | 2160 | 6.4 | |
| P46A | NS: 15 volume % | 2364 | 6.4 | Hv is about 10% greater than that of P47A |

Notably, at high operating temperatures above 500° C., hardmetal samples with Ni-based superalloy in the binder can exhibit a material hardness that is significantly higher than that of similar hardmetal samples without having a Ni-based superalloy in the binder. In addition, Ni-based superalloy as a binder material can also improve the resistance to corrosion of the resulting hardmetals or cermets in comparison with hardmetals or cermets using the conventional cobalt as the binder.

A nickel-based superalloy may be used alone or in combination with other elements to form a desired binder matrix. Other elements that may be combined with the nickel-based superalloy to form a binder matrix include but are not limited to, another nickel-based superalloy, other non-nickel-based alloys, Re, Co, Ni, Fe, Mo, and Cr.

Rhenium as a binder material may be used to provide strong bonding of hard particles and in particular can produce a high melting point for the resulting hardmetal material. The melting point of rhenium is about 3180° C., much higher than the melting point of 1495° C. of the commonly-used cobalt as a binder material. This feature of rhenium partially contributes to the enhanced performance of hardmetals with binders using Re, e.g., the enhanced hardness and strength of the resulting hardmetals at high temperatures. Re also has other desired properties as a binder material. For example, the hardness, the transverse rapture strength, the fracture toughness, and the melting point of the hardmetals with Re in their binder matrices can be increased significantly in comparison with similar hardmetals without Re in the binder matrices. A hardness Hv over 2600 $Kg/mm^2$ has been achieved in exemplary WC-based hardmetals with Re in the binder matrices. The melting point of some exemplary WC-based hardmetals, i.e., the sintering temperature, has shown to be greater than 2200° C. In comparison, the sintering temperature for WC-based hardmetals with Co in the binders in Table 2.1 in the cited Brookes is below 1500° C. A hardmetal with a high sintering temperature allows the material to operate at a high temperature below the sintering temperature. For example, tools based on such Re-containing hardmetal materials may operate at high speeds to reduce the processing time and the overall throughput of the processing.

The use of Re as a binder material in hardmetals, however, may present limitations in practice. For example, the desirable high-temperature property of Re generally leads to a high sintering temperature for fabrication. Thus, the oven or furnace for the conventional sintering process needs to operate at or above the high sintering temperature. Ovens or furnaces is capable of operating at such high temperatures, e.g., above 2200° C., can be expensive and may not be widely available for commercial use. U.S. Pat. No. 5,476,531 discloses a use of a rapid omnidirectional compaction (ROC) method to reduce the processing temperature in manufacturing WC-based hardmetals with pure Re as the binder material from 6% to 18% of the total weight of each hardmetal. This ROC process, however, is still expensive and is generally not suitable for commercial fabrication.

One potential advantage of the hardmetal compositions and the composition methods described here is that they may provide or allow for a more practical fabrication process for fabricating hardmetals with either Re or mixtures of Re with other binder materials in the binder matrices. In particular, this two-step process makes it possible to fabricate hardmetals where Re is at or more than 25% of the total weight of the binder matrix in the resulting hardmetal. Such hardmetals with equal to or more than 25% Re may be used to achieve a high material hardness and a material strength at high temperatures.

Another limitation of using pure Re as a binder material for hardmetals is that Re oxidizes severely in air at or above about 350° C. This poor oxidation resistance may dramatically reduce the use of pure Re as binder for any application above is about 300° C. Since Ni-based superalloy has exceptionally strength and oxidation resistance under 1000° C., a mixture of a Ni-based superalloy and Re where Re is the dominant material in the binder may be used to improve the strength and oxidation resistance of the resulting hardmetal using such a mixture as the binder. On the other hand, the addition of Re into a binder primarily comprised of a Ni-based superalloy can increase the melting range of the resulting hardmetal, and improve the high temperature strength and creep resistance of the Ni-based superalloy binder.

In general, the percentage weight of the rhenium in the binder matrix should be between a several percent to essentially 100% of the total weight of the binder matrix in a hardmetal. Preferably, the percentage weight of rhenium in the binder matrix should be at or above 5%. In particular, the percentage weight of rhenium in the binder matrix may be at or above 10% of the binder matrix. In some implementations, the percentage weight of rhenium in the binder matrix may be at or above 25% of the total weight of the binder matrix in the resulting hardmetal. Hardmetals with such a high concentration of Re may be fabricated at relatively low temperatures with a two-step process described in this application.

Since rhenium is generally more expensive than other materials used in hardmetals, cost should be considered in designing binder matrices that include rhenium. Some of the examples given below reflect this consideration. In general, according to one implementation, a hardmetal composition includes dispersed hard particles having a first material, and a binder matrix having a second, different material that includes rhenium, where the hard particles are spatially dispersed in the binder matrix in a substantially uniform manner. The binder matrix may be a mixture of Re and other binder materials to reduce the total content of Re to in part reduce the overall cost of the raw materials and in part to explore the presence of other binder materials to enhance the performance of the binder matrix. Examples of binder matrices having mixtures of Re and other binder materials include, mixtures of Re and at least one Ni-based superalloy, mixtures of Re, Co and at least one Ni-based superalloy, mixtures of Re and Co, and others.

TABLE 1 lists some examples of hardmetal compositions of interest. In this table, WC-based compositions are referred to as "hardmetals" and the TiC-based compositions are referred to as "cermets." Traditionally, TiC particles bound by a mixture of Ni and Mo or a mixture of $N_1$ and $MO_2C$ are cermets. Cermets as described here further include hard particles formed by mixtures of TiC and TiN, of TiC, TiN, WC, TaC, and NbC with the binder matrices formed by the mixture of Ni and Mo or the mixture of $N_1$ and $MO_2C$. For each hardmetal composition, three different weight percentage ranges for the given binder material in the are listed. As an example, the binder may be a mixture of a Ni-based superalloy and cobalt, and the hard particles may a mixture of WC, TiC, TaC, and NbC. In this composition, the binder may be from about 2% to about 40% of the total weight of the hardmetal. This range may be set to from about 3% to about 35% in some applications and may be further limited to a smaller range from about 4% to about 30% in other applications.

TABLE 1

(NS: Ni-based supperalloy)

| Binder Composition | Composition for Hard Particles | 1st Binder Wt. % Range | 2nd Binder Wt. % Range | 3rd Binder Wt. % Range |
|---|---|---|---|---|
| Hardmetals | | | | |
| Re | WC | 4 to 40 | 5 to 35 | 6 to 30 |
| | WC—TiC—TaC—NbC | 4 to 40 | 5 to 35 | 6 to 30 |
| NS | WC | 2 to 30 | 3 to 25 | 4 to 20 |
| | WC—TiC—TaC—NbC | 2 to 30 | 3 to 25 | 4 to 20 |
| NS—Re | WC | 2 to 40 | 3 to 35 | 4 to 30 |
| | WC—TiC—TaC—NbC | 2 to 40 | 3 to 35 | 4 to 30 |
| Re—Co | WC | 2 to 40 | 3 to 35 | 4 to 30 |
| | WC—TiC—TaC—NbC | 2 to 40 | 3 to 35 | 4 to 30 |
| NS—Re—Co | WC | 2 to 40 | 3 to 35 | 4 to 30 |
| | WC—TiC—TaC—NbC | 2 to 40 | 3 to 35 | 4 to 30 |
| Cermets | | | | |
| NS | $Mo_2C$—TiC | 5 to 40 | 6 to 35 | 8 to 40 |
| | $Mo_2C$—TiC—TiN—WC—TaC—NbC | 5 to 40 | 6 to 35 | 8 to 40 |
| Re | $Mo_2C$—TiC | 10 to 55 | 12 to 50 | 15 to 45 |
| | $Mo_2C$—TiC—TiN—WC—TaC—NbC | 10 to 55 | 12 to 50 | 15 to 45 |
| NS—Re | $Mo_2C$—TiC | 5 to 55 | 6 to 50 | 8 to 45 |
| | $Mo_2C$—TiC—TiN—WC—TaC—NbC | 5 to 55 | 6 to 50 | 8 to 45 |

Fabrication of hardmetals with Re or a nickel-based superalloy in binder matrices may be carried out as follows. First, a powder with desired hard particles such as one or more carbides or carbonitrides is prepared. This powder may include a mixture of different carbides or a mixture of carbides and nitrides. The powder is mixed with a suitable binder matrix material that includes Re or a nickel-based superalloy. In addition, a pressing lubricant, e.g., a wax, may be added to the mixture.

The mixture of the hard particles, the binder matrix material, and the lubricant is mixed through a milling or attriting process by milling or attriting over a desired period, e.g., hours, to fully mix the materials so that each hard particle is coated with the binder matrix material to facilitate the binding of the hard particles in the subsequent processes. The hard particles should also be coated with the lubricant material to lubricate the materials to facilitate the mixing process and to reduce or eliminate oxidation of the hard particles. Next, pressing, pre-sintering, shaping, and final sintering are subsequently performed to the milled mixture to form the resulting hardmetal. The sintering process is a process for converting a powder material into a continuous mass by heating to a temperature that is below the melting temperature of the hard particles and may be performed after preliminary compacting by pressure. During this process, the binder material is densified to form a continuous binder matrix to bind hard particles therein. One or more additional coatings may be further formed on a surface of the resulting hardmetal to enhance the performance of the hardmetal. FIG. 1 is a flowchart for this implementation of the fabrication process.

In one implementation, the manufacture process for cemented carbides includes wet milling in solvent, vacuum drying, pressing, and liquid-phase sintering in vacuum. The temperature of the liquid-phase sintering is between melting point of the binder material (e.g., Co at 1495° C.) and the eutectic temperature of the mixture of hardmetal (e.g., WC—Co at 1320° C.). In general, the sintering temperature of cemented carbide is in a range of 1360 to 1480° C. For new materials with low concentration of Re or a Ni-based superalloy in binder alloy, manufacture process is same as conventional cemented carbide process. The principle of liquid phase sintering in vacuum is applied in here. The sintering temperature is slightly higher than the eutectic temperature of binder alloy and carbide. For example, the sintering condition of P17 (25% of Re in binder alloy, by weight) is at 1700° C. for one hour in vacuum.

Figure 2:
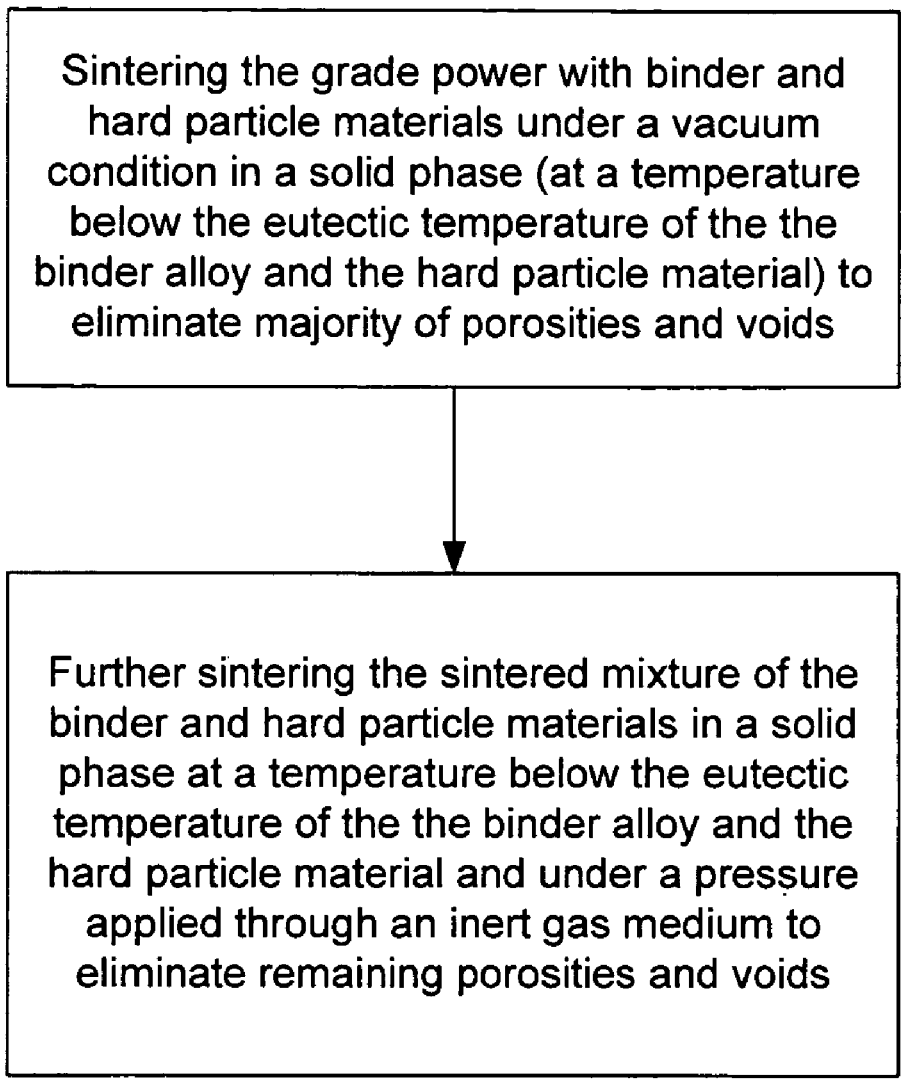
FIG. 2 shows an exemplary two-step sintering process for processing hardmetals in a solid state.

FIG. 2 shows a two-step fabrication process based on a solid-state phase sintering for fabricating various hardmetals described in this application. Examples of hardmetals that can be fabricated with this two-step sintering method include hardmetals with a high concentration of Re in the binder matrix that would otherwise require the liquid-phase sintering at high temperatures. This two-step process may be implemented at relatively low temperatures, e.g., under 2200° C., to utilize commercially feasible ovens and to produce the hardmetals at reasonably low costs. The liquid phase sintering is eliminated in this two-step process because the liquid phase sintering may not be practical due to the generally high eutectic temperatures of the binder alloy and carbide. As discussed above, sintering at such high temperatures requires ovens operating at high temperatures which may not be commercially feasible.

The first step of this two-step process is a vacuum sintering where the mixture materials for the binder matrix and the hard particles are sintered in vacuum. The mixture is initially processed by, e.g., wet milling, drying, and pressing, as performed in conventional processes for fabricating cemented carbides. This first step of sintering is performed at a temperature below the eutectic temperature of the binder alloy and the hard particle materials to remove or eliminate the interconnected porosity. The second step is a solid phase sintering at a temperature below the eutectic temperature and under a pressured condition to remove and eliminate the remaining porosities and voids left in the sintered mixture after the first step. A hot isostatic pressing (HIP) process may be used as this second step sintering. Both heat and pressure are applied to the material during the sintering to reduce the processing temperature which would otherwise be higher in absence of the pressure. A gas medium such as an inert gas may be used to apply and transmit the pressure to the sintered mixture. The pressure may be at or over 1000 bar. Application of pressure in the HIP process lowers the required processing temperature and allows for use of conventional ovens or furnaces. The temperatures of solid phase sintering and HIPping for achieving fully condensed materials are generally significantly lower than the temperatures for liquid phase sintering. For example, the sample P62 which uses pure Re as the binder may be fully densified by vacuum sintering at 2200° C. for one to two hours and then HIPping at about 2000° C. under a pressure of 30,000 PSI in the inert gas such as Ar for about one hour. Notably, the use of ultra fine hard particles with a particulate dimension less than 0.5 micron can reduce the sintering temperature for fully densifying the hardmetals (fine particles are several microns in size). For example, in making the samples P62 and P63, the use of such ultra fine WC allows for sintering temperatures to be low, e.g., around 2000° C. This two-step process is less expensive than the ROC method and may be used to commercial production.

The following sections describe exemplary hardmetal compositions and their properties based on various binder matrix materials that include at least rhenium or a nickel-based superalloy.

TABLE 2 provides a list of code names (lot numbers) for some of the constituent materials used to form the exemplary hardmetals, where H1 represents rhenium, and L1, L2, and L3 represent three exemplary commercial nickel-based superalloys. TABLE 3 further lists compositions of the above three exemplary nickel-based superalloys, Udimet720 (U720), Rene'95(R-95), and Udimet700(U700), respectively. TABLE 4 lists compositions of exemplary hardmetals, both with and without rhenium or a nickel-based superalloy in the binder matrices. For example, the material composition for Lot P17 primarily includes 88 grams of T32 (WC), 3 grams of I32 (TiC), 3 grams of A31 (TaC), 1.5 grams of H1 (Re) and 4.5 grams of L2 (R-95) as binder, and 2 grams of a wax as lubricant. Lot P58 represents a hardmetal with a nickel-based superalloy L2 as the only binder material without Re. These hardmetals were fabricated and tested to illustrate the effects of either or both of rhenium and a nickel-based superalloy as binder materials on various properties of the resulting hardmetals. TABLES 5-8 further provide summary information of compositions and properties of different sample lots as defined above.

Figure 3:
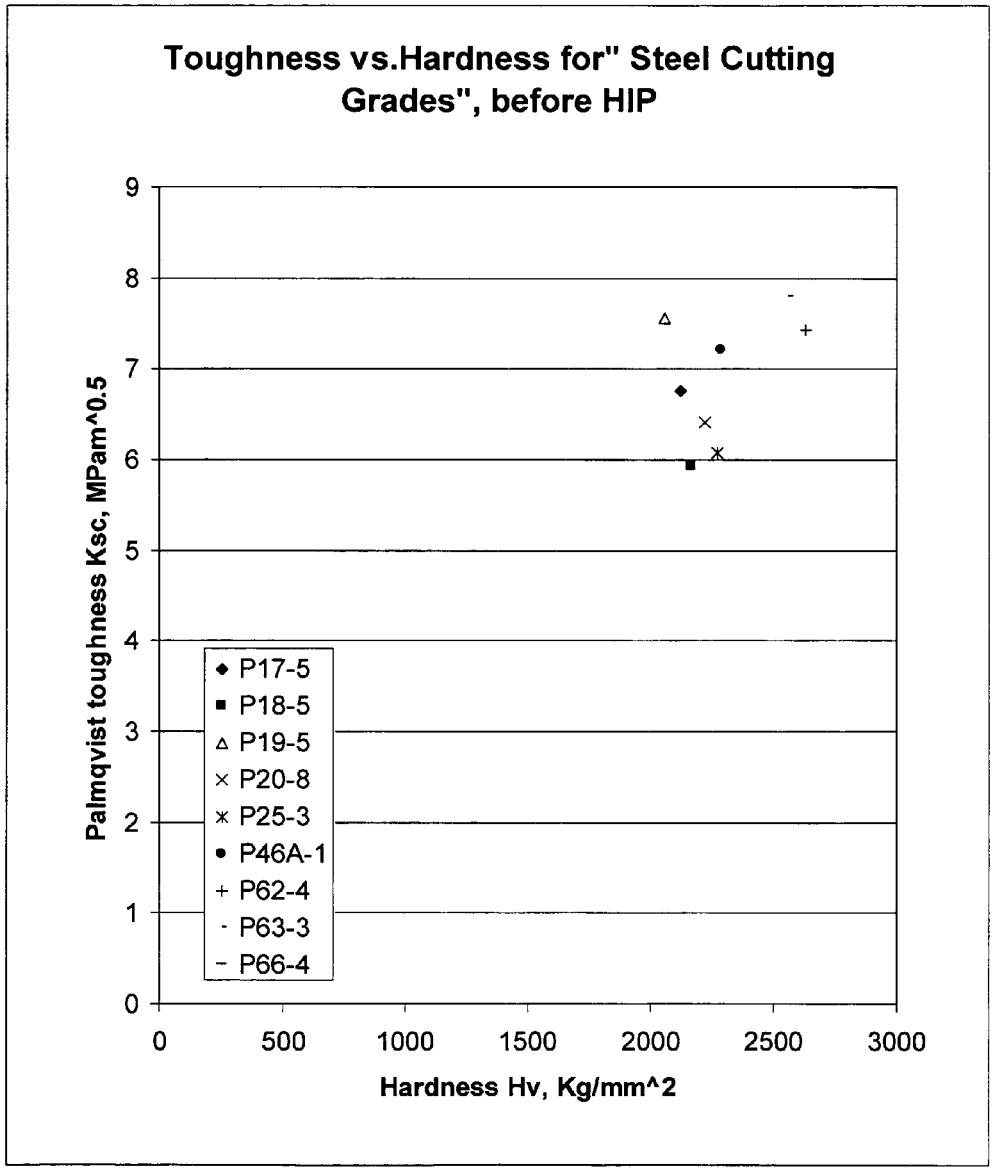
FIGS. 3, 4, 5, 6, 7 and 8 show various properties of selected exemplary hardmetals.
Figure 4:
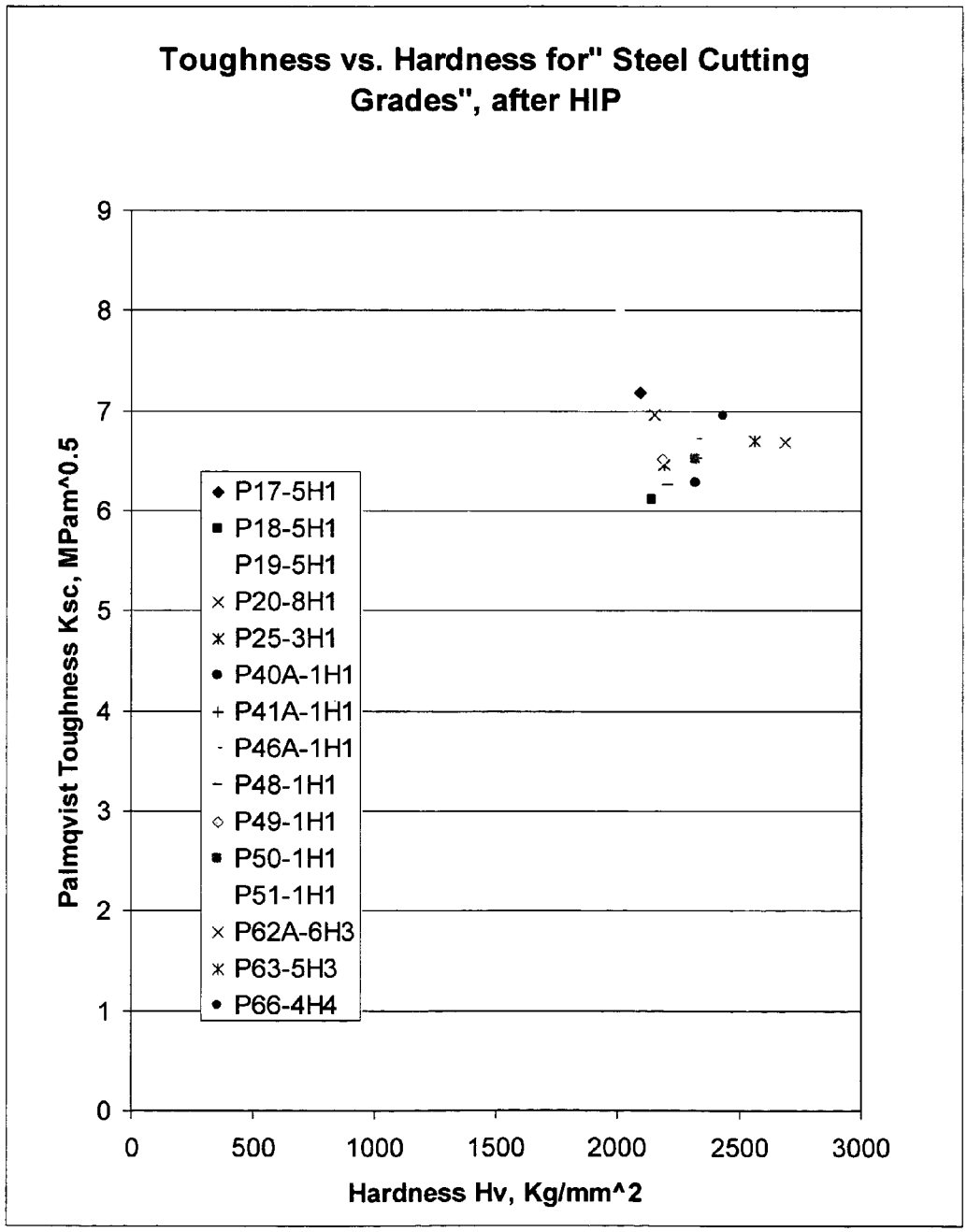
Figure 5:
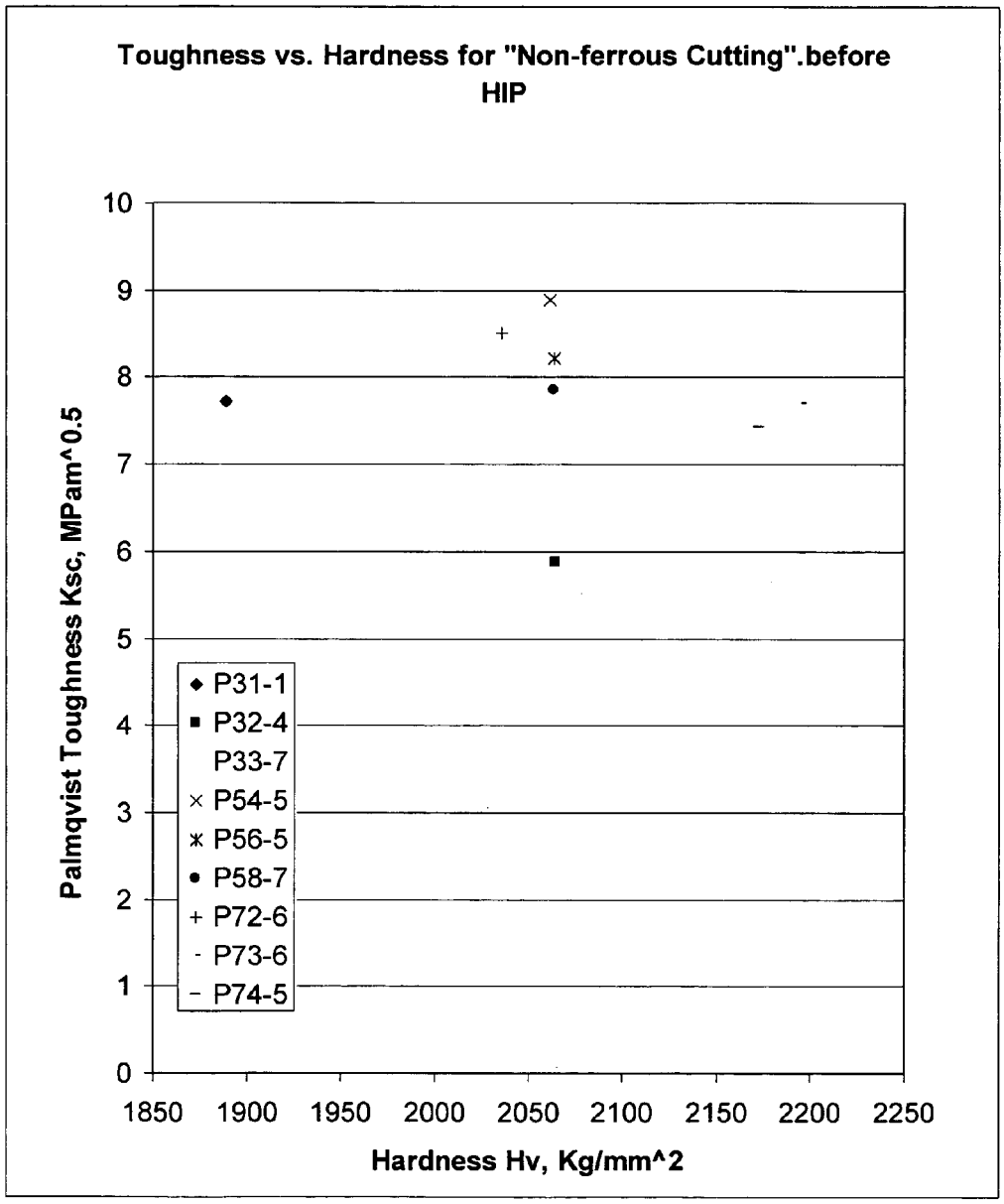
Figure 6:
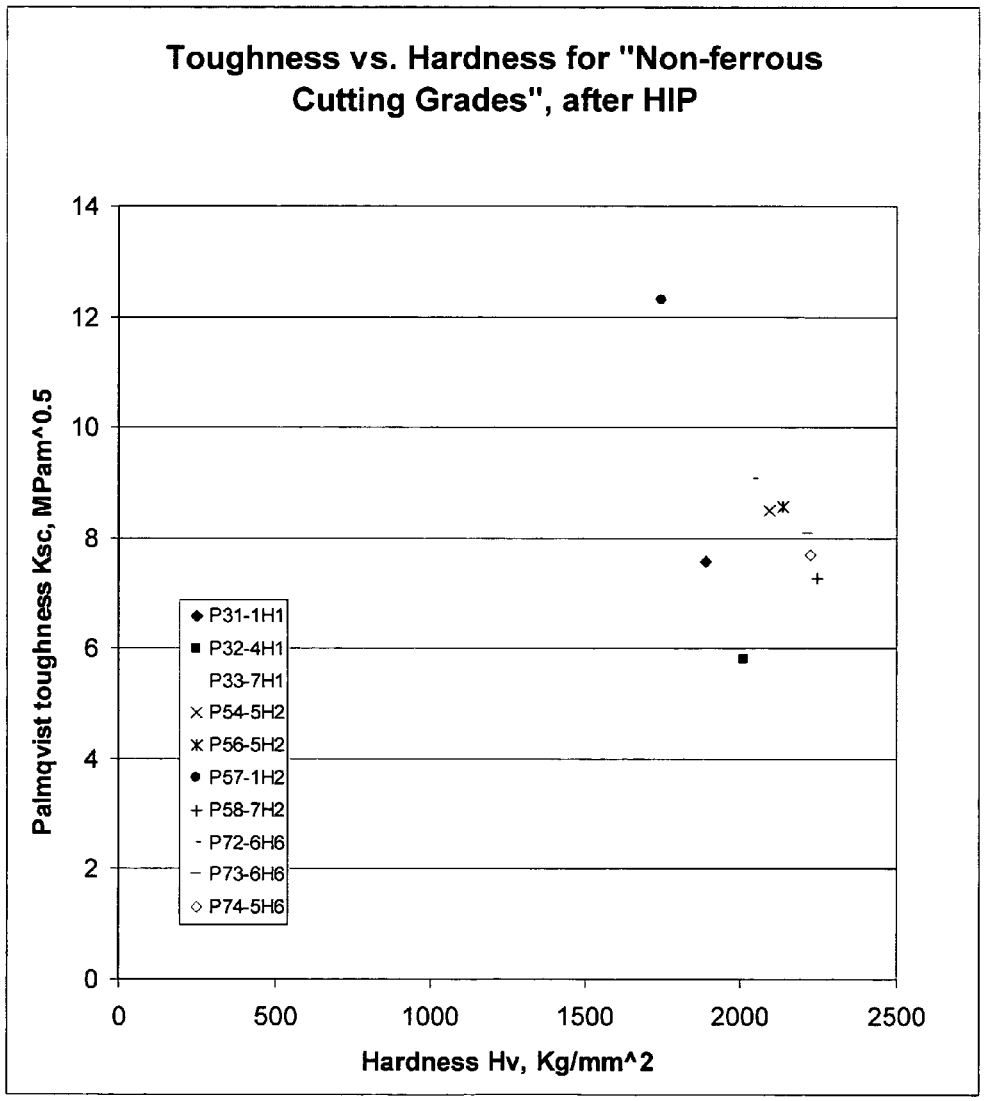
Figure 7:
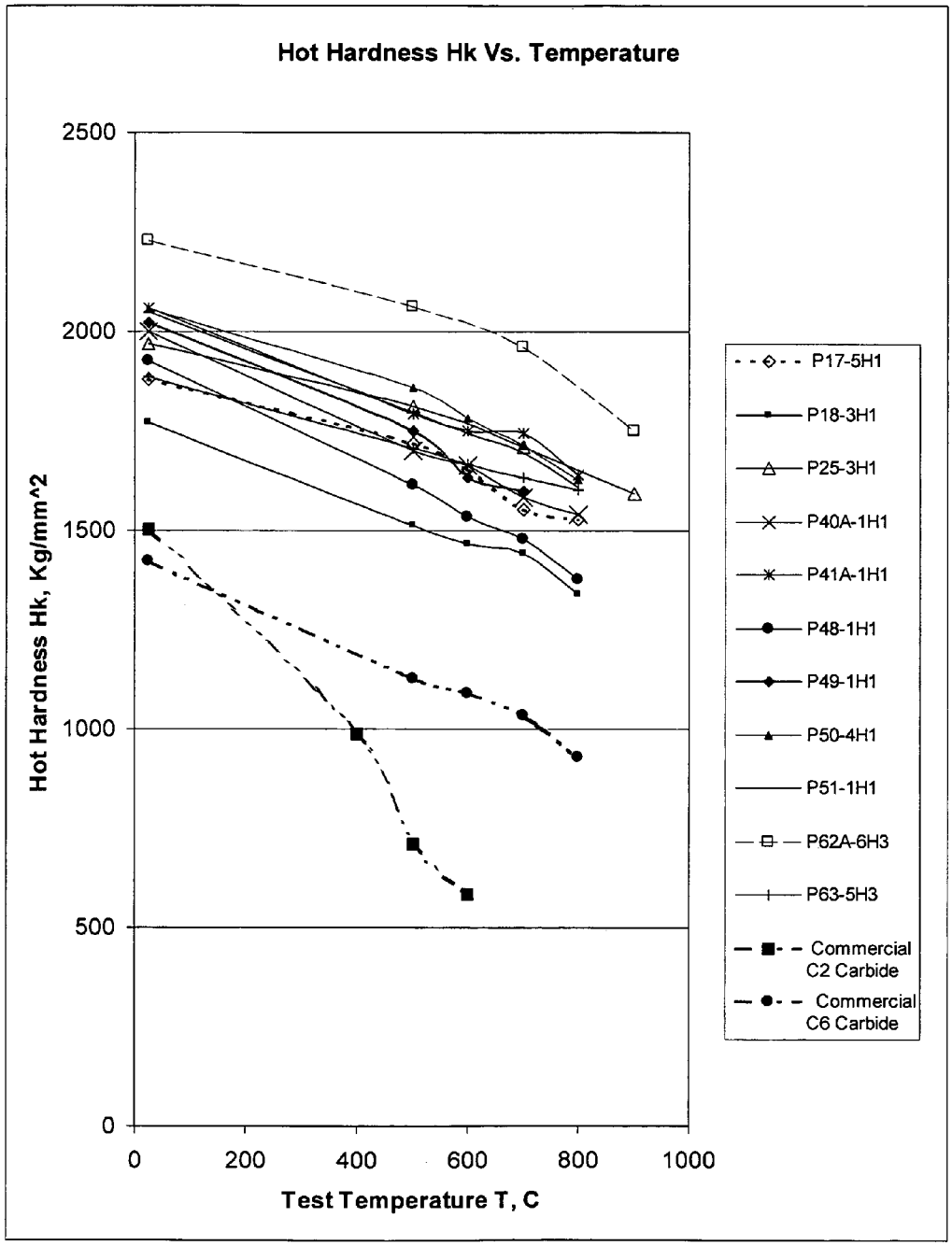
Figure 8:
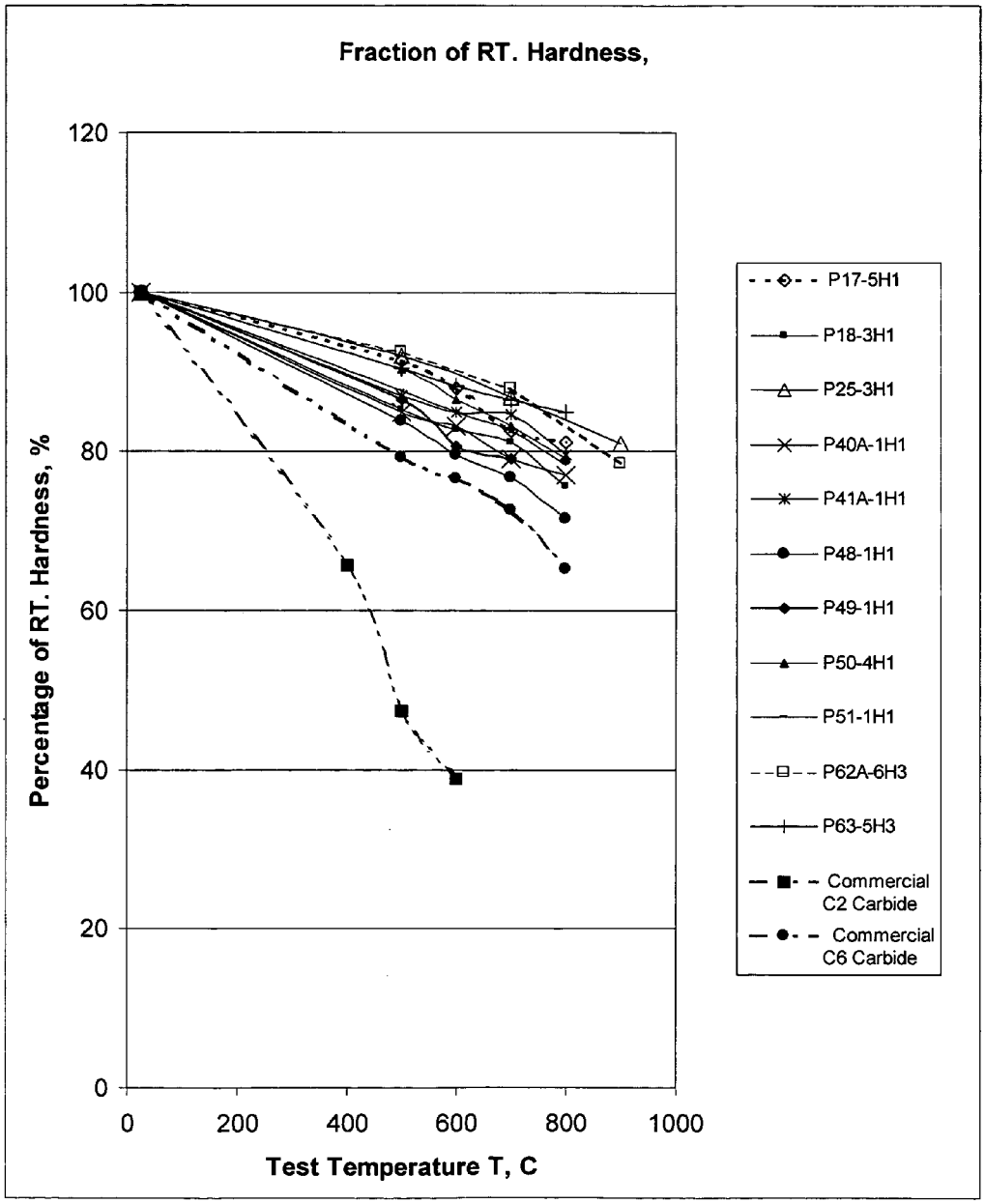

FIGS. 3 through 8 show measurements of selected hardmetal samples of this application. FIGS. 3 and 4 show measured toughness and hardness parameters of some exemplary hardmetals for the steel cutting grades. FIGS. 5 and 6 show measured toughness and hardness parameters of some exemplary hardmetals for the non-ferrous cutting grades. Measurements were performed before and after the solid-phase sintering HIP process and the data suggests that the HIP process significantly improves both the toughness and the hardness of the materials. FIG. 7 shows measurements of the hardness as a function of temperature for some samples. As a comparison, FIGS. 7 and 8 also show measurements of commercial C2 and C6 carbides under the same testing conditions, where FIG. 7 shows the measured hardness and FIG. 8 shows measured change in hardness from the value at the room temperature (RT). Clearly, the hardmetal samples based on the compositions described here outperform the commercial grade materials in terms of the hardness at high temperatures. These results demonstrate that the superior performance of binder matrices with either or both of Re and a nickel-based superalloy as binder materials in comparison with Co-based binder matrix materials.

TABLE 2

| Code | Powder Composition | Note |
|---|---|---|
| T32 | WC | Particle size 1.5 μm, from Alldyne |
| T35 | WC | Particle size 15 μm, from Alldyne |
| Y20 | Mo | Particle size 1.7-2.2 μm, from Alldyne |
| L3 | U-700 | −325 Mesh, special metal Udimet 700 |
| L1 | U-720 | −325 Mesh, Special Metal, Udimet 720 |
| L2 | Re-95 | −325 Mesh, Special Metal, Rene 95 |
| H1 | Re | −325 Mesh, Rhenium Alloy Inc. |
| I32 | TiC | from AEE, Ti-302 |
| I21 | $TiB_2$ | from AEE, Ti-201, 1-5 μm |

TABLE 2-continued

| Code | Powder Composition | Note |
|---|---|---|
| A31 | TaC | from AEE, TA-301 |
| Y31 | $Mo_2C$ | from AEE, MO-301 |
| D31 | VC | from AEE, VA-301 |
| B1 | Co | from AEE, CO-101 |
| K1 | Ni | from AEE, Ni-101 |
| K2 | Ni | from AEE, Ni-102 |
| I13 | TiN | from Cerac, T-1153 |
| C21 | ZrB2 | from Cerac, Z-1031 |
| Y6 | Mo | from AEE Mo+100, 1-2 μm |
| L6 | Al | from AEE Al-100, 1-5 μm |
| R31 | $B_4C$ | from AEE Bo-301, 3 μm |
| T3.8 | WC | Particle size 0.8 μm, Alldyne |
| T3.4 | WC | Particle size 0.4 μm, OMG |
| T3.2 | WC | Particle size 0.2 μm, OMG |

TABLE 3

| | Ni | Co | Cr | Al | Ti | Mo | Nb | W | Zr | B | C | V |
|---|---|---|---|---|---|---|---|---|---|---|---|---|
| R95 | 61.982 | 8.04 | 13.16 | 3.54 | 2.53 | 3.55 | 3.55 | 3.54 | 0.049 | | 0.059 | |
| U700 | 54.331 | 17.34 | 15.35 | 4.04 | 3.65 | 5.17 | .028 | .008 | .04 | .019 | .019 | .005 |
| U720 | 56.334 | 15.32 | 16.38 | 3.06 | 5.04 | 3.06 | 0.01 | 1.30 | .035 | .015 | .012 | .004 |

TABLE 4

| Lot No | Composition (units in grams) |
|---|---|
| P17 | H1 = 1.5, L2 = 4.5, I32 = 3, A31 = 3, T32 = 88, Wax = 2 |
| P18 | H1 = 3, L2 = 3, I32 = 3, A31 = 3, T32 = 88, Wax = 2 |
| P19 | H1 = 1.5, L3 = 4.5, I32 = 3, A31 = 3, T32 = 88, Wax = 2 |
| P20 | H1 = 3, L3 = 3, I32 = 3, A31 = 3, T32 = 88, Wax = 2 |
| P25 | H1 = 3.75, L2 = 2.25, I32 = 3, A31 = 3, T32 = 88, Wax = 2 |
| P25A | H1 = 3.75, L2 = 2.25, I32 = 3, A31 = 3, T32 = 88, Wax = 2 |
| P31 | H1 = 3.44, B1 = 4.4, T32 = 92.16, Wax = 2 |
| P32 | H1 = 6.75, B1 = 2.88, T32 = 90.37, Wax = 2 |
| P33 | H1 = 9.93, B1 = 1.41, T32 = 88.66, Wax = 2 |
| P34 | L2 = 14.47, I32 = 69.44, Y31 = 16.09 |
| P35 | H1 = 8.77, L2 = 10.27, I32 = 65.73, Y31 = 15.23 |
| P36 | H1 = 16.66, L2 = 6.50, I32 = 62.4, Y31 = 14.56 |
| P37 | H1 = 23.80, L2 = 3.09, I32 = 59.38, Y31 = 13.76 |
| P38 | K1 = 15.51, I32 = 68.60, Y31 = 15.89 |
| P39 | K2 = 15.51, I32 = 68.60, Y31 = 15.89 |
| P40 | H1 = 7.57, L2 = 2.96, I32 = 5.32, A31 = 5.23, T32 = 78.92, Wax = 2 |
| P40A | H1 = 7.57, L2 = 2.96, I32 = 5.32, A31 = 5.23, T32 = 78.92, Wax = 2 |
| P41 | H1 = 11.1, L2 = 1.45, I32 = 5.20, A31 = 5.11, T32 = 77.14, Wax = 2 |
| P41A | H1 = 11.1, L2 = 1.45, I32 = 5.20, A31 = 5.11, T32 = 77.14, Wax = 2 |
| P42 | H1 = 9.32, L2 = 3.64, I32 = 6.55, A31 = 6.44, I21 = 0.40, R31 = 4.25, T32 = 69.40, |
| P43 | H1 = 9.04, L2 = 3.53, I32 = 6.35, A31 = 6.24, I21 = 7.39, R31 = 0.22, T32 = 67.24, |
| P44 | H1 = 8.96, L2 = 3.50, I32 = 14.69, A31 = 6.19, T32 = 66.67, Wax = 2 |
| P45 | H1 = 9.37, L2 = 3.66, I32 = 15.37, A31 = 6.47, Y31 = 6.51, T32 = 58.61, Wax = 2 |
| P46 | H1 = 11.40, L2 = 4.45, I32 = 5.34, A31 = 5.25, T32 = 73.55, Wax = 2 |
| P46A | H1 = 11.40, L2 = 4.45, I32 = 5.34, A31 = 5.25, T32 = 73.55, Wax = 2 |
| P47 | H1 = 11.35, B1 = 4.88, I32 = 5.32, A31 = 5.23, T32 = 73.22, Wax = 2 |
| P47A | H1 = 11.35, B1 = 4.88, I32 = 5.32, A31 = 5.23, T32 = 73.22, Wax = 2 |
| P48 | H1 = 3.75, L2 = 2.25, I32 = 5, A31 = 5, T32 = 84, Wax = 2 |
| P49 | H1 = 7.55, B1 = 3.25, I32 = 5.31, A31 = 5.21, T32 = 78.68, Wax = 2 |

TABLE 4-continued

| Lot No | Composition (units in grams) |
|---|---|
| P50 | H1 = 4.83, L2 = 1.89, I32 = 5.31, A31 = 5.22, T32 = 82.75, Wax = 2 |
| P51 | H1 = 7.15, L2 = 0.93, I32 = 5.23, A31 = 5.14, T32 = 81.55, Wax = 2 |
| P52 | B1 = 8, D31 = 0.6, T3.8 = 91.4, Wax = 2 |
| P53 | B1 = 8, D31 = 0.6, T3.4 = 91.4, Wax = 2 |
| P54 | B1 = 8, D31 = 0.6, T3.2 = 91.4, Wax = 2 |
| P55 | H1 = 1.8, B1 = 7.2, D31 = 0.6, T3.4 = 90.4, Wax = 2 |
| P56 | H1 = 1.8, B1 = 7.2, D31 = 0.6, T3.2 = 90.4, Wax = 2 |
| P56A | H1 = 1.8, B1 = 7.2, D31 = 0.6, T3.2 = 90.4, Wax = 2 |
| P57 | H1 = 1.8, B1 = 7.2, T3.2 = 91, Wax = 2 |
| P58 | L2 = 7.5, D31 = 0.6, T3.2 = 91.9, Wax = 2 |
| P59 | H1 = 0.4, B1 = 3, L2 = 4.5, D31 = 0.6, T3.2 = 91.5, Wax = 2 |
| P62 | H1 = 14.48, I32 = 5.09, A31 = 5.00, T3.2 = 75.43, Wax = 2 |
| P62A | H1 = 14.48, I32 = 5.09, A31 = 5.00, T3.2 = 75.43, Wax = 2 |

TABLE 4-continued

| Lot No | Composition (units in grams) |
|---|---|
| P63 | H1 = 12.47, L2 = 0.86, I32 = 5.16, A31 = 5.07, T3.2 = 76.45, Wax = 2 |
| P65 | H1 = 7.57, L2 = 2.96, I32 = 5.32, A31 = 5.23, T3.2 = 78.92, Wax = 2 |
| P65A | H1 = 7.57, L2 = 2.96, I32 = 5.32, A31 = 5.23, T3.2 = 78.92, Wax = 2 |
| P66 | H1 = 27.92, I32 = 4.91, A31 = 4.82, T3.2 = 62.35, Wax = 2 |
| P67 | H1 = 24.37, L3 = 1.62, I32 = 5.04, A31 = 4.95, T32 = 32.01, T33 = 32.01, Wax = 2 |
| P69 | L2 = 7.5, D31 = 0.4, T3.2 = 92.1, Wax = 2 |
| P70 | L1 = 7.4, D31 = 0.3, T3.2 = 92.3, Wax = 2 |
| P71 | L3 = 7.2, D31 = 0.3, T3.2 = 92.5, Wax = 2 |
| P72 | H1 = 1.8, B1 = 7. 2, D31 = 0.3, T3.2 = 90.7, Wax = 2 |
| P73 | H1 = 1.8, B1 = 4.8, L2 = 2.7, D31 = 0.3, T3.2 = 90.4, Wax = 2 |
| P74 | H1 = 1.8, B1 = 3, L2 = 4.5, D31 = 0.3, T3.2 = 90.4, Wax = 2 |
| P75 | H1 = 0.8, B1 = 3, L2 = 4.5, D31 = 0.3, T3.2 = 91.4, Wax = 2 |
| P76 | H1 = 0.8, B1 = 3, L1 = 4.5, D31 = 0.3, T3.2 = 91.4, Wax = 2 |
| P77 | H1 = 0.8, B1 = 3, L3 = 4.5, D31 = 0.3, T3.2 = 91.4, Wax = 2 |
| P78 | H1 = 0.8, B1 = 4.5, L1 = 3, D31 = 0.3, T3.2 = 91.4, Wax = 2 |
| P79 | H1 = 0.8, B1 = 4.5, L3 = 3.1, D31 = 0.3, T3.2 = 91.3, Wax = 2 |

Several exemplary categories of hardmetal compositions are described below to illustrate the above general designs of the various hardmetal compositions to include either of Re and Nickel-based superalloy, or both. The exemplary categories of hardmetal compositions are defined based on the compositions of the binder matrices for the resulting hardmetals or cermets. The first category uses a binder matrix having pure Re, the second category uses a binder matrix having a Re—Co alloy, the third category uses a binder matrix having a Ni-based superalloy, and the fourth category uses a binder matrix having an alloy having a Ni-based superalloy in combination with of Re with or without Co.

In general, hard and refractory particles used in hardmetals of interest may include, but are not limited to, Carbides, Nitrides, Carbonitrides, Borides, and Silicides. Some examples of Carbides include WC, TiC, TaC, HfC, NbC, $Mo_2C$, $Cr_2C_3$, VC, ZrC, $B_4C$, and SiC. Examples of Nitrides include TiN, ZrN, HfN, VN, NbN, TaN, and BN. Examples of Carbonitrides include Ti(C,N), Ta(C,N), Nb(C,N), Hf(C,N), Zr(C,N), and V(C,N). Examples of Borides include $TiB_2$, $ZrB_2$, $HfB_2$, $TaB_2$, $VB_2$, $MoB_2$, WB, and $W_2B$. In addition, examples of Silicides are $TaSi_2$, $Wsi_2$, $NbSi_2$, and $MoSi_2$. The above-identified four categories of hardmetals or cermets can also use these and other hard and refractory particles.

In the first category of hardmetals based on the pure Re alloy binder matrix, the Re may be approximately from 5% to 40% by volume of all material compositions used in a hardmetal or cermet. For example, the sample with a lot No. P62 in TABLE 4 has 10% of pure Re, 70% of WC, 15% of TiC, and 5% of TaC by volume. This composition approximately corresponds to 14.48% of Re, 75.43% of WC, 5.09% of TiC and 5.0% of TaC by weight. In fabrication, the Specimen P62-4 was vacuum sintered at 2100° C. for about one hour and 2158° C. for about one hour. The density of this material is about 14.51 g/cc, where the calculated density is 14.50 g/cc. The average hardness Hv is 2627±35 $Kg/mm^2$ for 10 measurements taken at the room temperature under a load of 10 Kg. The measured surface fracture toughness $K_{sc}$ is about $7.4\times10^6$ $Pa\cdot m^{1/2}$ estimated by Palmvist crack length at a load of 10 Kg.

Another example under this category is P66 in TABLE 4. This sample has about 20% of Re, 60% of WC, 15% of TiC, and 5% of TaC by volume in composition. In the weight percentage, this sample has about 27.92% of Re, 62.35% of WC, 4.91% of TiC, and 4.82% of TaC. The Specimen P66-4 was first processed with a vacuum sintering process at about 2200° C. for one hour and was then sintered in the solid-phase with a HIP process to remove porosities and voids. The density of the resulting hardmetal is about 14.40 g/cc compared to the calculated density of 15.04 g/cc. The average hardness Hv is about 2402±44 $Kg/mm^2$ for 7 different measurements taken at the room temperature under a load of 10 Kg. The surface fracture toughness $K_{sc}$ is about $8.1\times10^6$ $Pa\cdot m^{1/2}$. The sample P66 and other compositions described here with a high concentration of Re with a weight percentage greater than 25%, as the sole binder material or one of two or more different binder materials in the binder, may be used for various applications at high operating temperatures and may be manufactured by using the two-step process based on solid-phase sintering.

The microstructures and properties of Re bound multiples types of hard refractory particles, such as carbides, nitrides, carbonnitrides, silicides, and bobides, may provide advantages over Re-bound WC material. For example, Re bound WC—TiC—TaC may have better crater resistance in steel cutting than Re bound WC material. Another example is materials formed by refractory particles of $MO_2C$ and TiC bound in a Re binder.

For the second category with a Re—Co alloy as the binder matrix, the Re—Co alloy may be about from 5 to 40 Vol % of all material compositions used in the composition. In some implementations, the Re-to-Co ratio in the binder may vary from 0.01 to 0.99 approximately. Inclusion of Re can improve the mechanical properties of the resulting hardmetals, such as hardness, strength and toughness special at high temperature compared to Co bounded hardmetal. The higher Re content is the better high temperature properties are for most materials using such a binder matrix.

The sample P31 in TABLE 4 is one example within this category with 2.5% of Re, 7.5% of Co, and 90% of WC by volume, and 3.44% of Re, 4.40% of Co and 92.12% of WC by weight. In fabrication, the Specimen P31-1 was vacuum sintered at 1725 C for about one hour. slight under sintering with some porosities and voids. The density of the resulting hardmetal is about 15.16 g/cc (calculated density at 15.27 g/cc). The average hardness Hv is about 1889±18 $Kg/mm^2$ at the room temperature under 10 Kg and the surface facture toughness $K_{sc}$ is about $7.7\times10^6$ $Pa\cdot m^{1/2}$. In addition, the Specimen P31-1 was treated with a hot isostatic press (HIP) process at about 1600 C/15 Ksi for about one hour after sintering. The HIP reduces or substantially eliminates the porosities and voids in the compound to increase the material density. After HIP, the measured density is about 15.25 g/cc (calculated density at 15.27 g/cc). The measured hardness Hv is about 1887±12 $Kg/mm^2$ at the room temperature under 10 Kg. The surface fracture toughness $K_{sc}$ is about $7.6\times10^6$ $Pa\cdot m^{1/2}$.

Another example in this category is P32 in TABLE 4 with 5.0% of Re, 5.0% of Co, and 90% of WC in volume (6.75% of Re, 2.88% of Co and 90.38% of WC in weight). The Specimen P32-4 was vacuum sintered at 1800 C for about one hour. The measured density is about 15.58 g/cc in comparison with the calculated density at 15.57 g/cc. The measured hardness Hv is about 2065 $Kg/mm^2$ at the room temperature under 10 Kg. The surface fracture toughness $K_{sc}$ is about $5.9\times10^6$ $Pa\cdot m^{1/2}$. The Specimen P32-4 was also HIP at 1600 C/15Ksi for about one hour after Sintering. The measured density is about 15.57 g/cc (calculated density at 15.57 g/cc). The average hardness Hv is about 2010±12 $Kg/mm^2$ at the room temperature under 10 Kg. The surface fracture toughness $K_{sc}$ is about $5.8\times10^6$ $Pa\cdot m^{1/2}$.

The third example is P33 in TABLE 4 which has 7.5% of Re, 2.5% of Co, and 90% of WC by volume and 9.93% of Re, 1.41% of Co and 88.66% of WC by weight. In fabrication, the Specimen P33-7 was vacuum sintered at 1950 C for about one hour and was under sintering with porosities and voids. The measured density is about 15.38 g/cc (calculated density at 15.87 g/cc). The measured hardness Hv is about 2081 $Kg/mm^2$ at the room temperature under a force of 10 Kg. The surface fracture toughness Ksc is about $5.6\times10^6$ $Pa\cdot m^{1/2}$. The Specimen P33-7 was HIP at 1600 C/15Ksi for about one hour after Sintering. The measured density is about 15.82 g/cc (calculated density=15.87 g/cc). The average hardness Hv is measured at about 2039±18 $Kg/mm^2$ at the room temperature under 10 Kg. The surface fracture toughness Ksc is about $6.5\times10^6$ $Pa\cdot m^{1/2}$.

TABLE 5

Re—Co alloy bound hardmetals

| | Temperature ° C. | | Density g/cc | | Hv | Ksc $\times10^6$ | Grain |
|---|---|---|---|---|---|---|---|
| | Sinter | HIP | Calculated | Measured | $Kg/mm^2$ | $Pa\cdot m^{1/2}$ | size |
| P55-1 | 1350 | 1300 | 14.77 | 14.79 | 2047 | 8.6 | Ultra-fine |
| P56-5 | 1360 | 1300 | 14.77 | 14.72 | 2133 | 8.6 | Ultra-fine |
| P56A-4 | 1350 | 1300 | 14.77 | 14.71 | 2108 | 8.5 | Ultra-fine |
| P57-1 | 1350 | 1300 | 14.91 | 14.93 | 1747 | 12.3 | Fine |

The samples P55, P56, P56A, and P57 in TABLE 4 are also examples for the category with a Re—Co alloy as the binder matrix. These samples have about 1.8% of Re, 7.2% of Co, 0.6% of VC except that P57 has no VC, and finally WC in balance. These different compositions are made to study the effects of hardmetal grain size on Hv and Ksc. TABLE 5 lists the results.

TABLE 6

Properties of Ni-based superalloys, Ni, Re, and Co

| | Test Temp. C. | R-95 | U-700 | U720 | Nickel | Rhenium | Cobalt |
|---|---|---|---|---|---|---|---|
| Density (g/c.c.) | 21 | 8.2 | 7.9 | 8.1 | 8.9 | 21 | 8.9 |
| Melting Point (° C.) | | 1255 | 1205 | 1210 | 1450 | 3180 | 1495 |
| Elastic Modulus (Gpa) | 21 | 30.3 | 32.4 | 32.2 | 207 | 460 | 211 |
| Ultimate Tensile Strength (Mpa) | 21 | 1620 | 1410 | 1570 | 317 | 1069 | 234 |
| | 760 | 1170 | 1035 | 1455 | | | |
| | 800 | | | | | 620 | |
| | 870 | | 690 | 1150 | | | |
| | 1200 | | | | | 414 | |
| 0.2% Yield Strength (Mpa) | 21 | 1310 | 965 | 1195 | 60 | | |
| | 760 | 1100 | 825 | 1050 | | | |
| | 800 | | | | | | |
| | 870 | | 635 | | | | |
| | 1200 | | | | | | |
| Tensile Elongation (%) | 21 | 15 | 17 | 13 | 30 | >15 | |
| | 760 | 15 | 20 | 9 | | | |
| | 800 | | | | | 5 | |
| | 870 | | 27 | | | | |
| | 1200 | | | | | 2 | |
| Oxidation Resistance | | Excellent | Excellent | Excellent | Good | Poor | Good |

The third category is based on binder matrices with Ni-based superalloys from 5 to 40% in volume of all materials in the resulting hardmetal. Ni-based superalloys are a family of high temperature alloys with γ' strengthening. Three different strength alloys, Rene'95, Udimet 720, and Udimet 700 are used as examples to demonstrate binder strength effects on mechanical properties of hardmetals. The Ni-based superalloys have a high strength specially at elevated temperatures. Also, these alloys have good environmental resistance such as resistance to corrosion and oxidation at elevated temperature. Therefore, Ni-based superalloys can be used to increase the hardness of Ni-based superalloy bound hardmetals when compared to Cobalt bound hardmetals. Notably, the tensile strengths of the Ni-based superalloys are much stronger than the common binder material cobalt as shown by TABLE 6. This further shows that Ni-based superalloys are good binder materials for hardmetals.

One example for this category is P58 in TABLE 4 which has 7.5% of Rene'95, 0.6% of VC, and 91.9% of WC in weight and compares to cobalt bound P54 in TABLE 4 (8% of Co, 0.6% of VC, and 91.4% of WC). The hardness of P58 is significant higher than P54 as shown in TABLE 7.

TABLE 7

Comparison of P54 and P58

| | Sintering | HIP | Hv, Kg/mm$^2$ | Ksc × $10^6$ Pa · m$^{1/2}$ |
|---|---|---|---|---|
| P54-1 | 1350 C./1 hr | 1305° C. | 2094 | 8.8 |
| P54-2 | 1380 C./1 hr | 15 KSI under | 2071 | 7.8 |
| P54-3 | 1420 C./1 hr | Ar | 2107 | 8.5 |
| P58-1 | 1350, 1380, 1400, 1420, 1450, 1475 for 1 hour at each temperature | 1 hour | 2322 | 7.0 |
| P58-3 | 1450 C./1 hr | | 2272 | 7.4 |
| P58-5 | 1500 C./1 hr | | 2259 | 7.2 |
| P58-7 | 1550 C./1 hr | | 2246 | 7.3 |

The fourth category is Ni-based superalloy plus Re as binder, e.g., approximately from 5% to 40% by volume of all materials in the resulting hardmetal or cermet. Because addition of Re increases the melting point of binder alloy of Ni-based superalloy plus Re, the processing temperature of hardmetal with Ni-based superalloy plus Re binder increases as the Re content increases. Several hardmetals with different Re concentrations are listed in TABLE 8. TABLE 9 further shows the measured properties of the hardmetals in TABLE 8.

TABLE 8

Hardmetal with Ni-based superalloy plus Re binder

| | Composition, weight % | | | | | | | Re to Binder | Sintering Temperature |
|---|---|---|---|---|---|---|---|---|---|
| | Re | Rene95 | U-700 | U-720 | WC | TiC | TaC | Ratio | ° C. |
| P17 | 1.5 | 4.5 | | | 88 | 3 | 3 | 25% | 1600~1750 |
| P18 | 3 | 3.0 | | | 88 | 3 | 3 | 50% | 1600~1775 |
| P25 | 3.75 | 2.25 | | | 88 | 3 | 3 | 62.5% | 1650~1825 |
| P48 | 3.75 | 2.25 | | | 84 | 5 | 5 | 62.5% | 1650~1825 |
| P50 | 4.83 | 1.89 | | | 82.75 | 5.31 | 5.22 | 71.9% | 1675~1850 |
| P40 | 7.57 | 2.96 | | | 78.92 | 5.32 | 5.23 | 71.9% | 1675~1850 |
| P46 | 11.40 | 4.45 | | | 73.55 | 5.34 | 5.24 | 71.9% | 1675~1850 |
| P51 | 7.15 | 0.93 | | | 81.55 | 5.23 | 5.14 | 88.5% | 1700~1900 |
| P41 | 11.10 | 1.45 | | | 77.14 | 5.20 | 5.11 | 88.5% | 1700~1900 |
| P63 | 12.47 | 0.86 | | | 76.45 | 5.16 | 5.07 | 93.6% | 1850~2100 |
| P19 | 1.5 | | 4.5 | | 88 | 3 | 3 | 25% | 1600~1750 |
| P20 | 3 | | 3 | | 88 | 3 | 3 | 50% | 1600~1775 |
| P67 | 24.37 | | 1.62 | | 64.02 | 5.04 | 4.95 | 93.6% | 1950~2300 |

TABLE 9

Properties of hardmetals bound by Ni-based superalloy and Re

| | Temperature, ° C. | | Density, g/cc | | Hv | Ksc $\times 10^6$ |
|---|---|---|---|---|---|---|
| | Sinter | HIP | Calculated | Measured | Kg/mm$^2$ | Pa · m$^{1/2}$ |
| P17 | 1700 | | 14.15 | 14.18 | 2120 | 6.8 |
| P17 | 1700 | 1600 | 14.15 | 14.21 | 2092 | 7.2 |
| P18 | 1700 | | 14.38 | 14.47 | 2168 | 5.9 |
| P18 | 1700 | 1600 | 14.38 | 14.42 | 2142 | 6.1 |
| P25 | 1750 | | 14.49 | 14.41 | 2271 | 6.1 |
| P25 | 1750 | 1600 | 14.49 | 14.48 | 2193 | 6.5 |
| P48 | 1800 | 1600 | 13.91 | 13.99 | 2208 | 6.3 |
| P50 | 1800 | 1600 | 13.9 | 13.78 | 2321 | 6.5 |
| P40 | 1800 | | 13.86 | 13.82 | 2343 | |
| P40 | 1800 | 1600 | 13.86 | 13.86 | 2321 | 6.3 |
| P46 | 1800 | | 13.81 | 13.88 | 2282 | 7.1 |
| P46 | 1800 | 1725 | 13.81 | 13.82 | 2326 | 6.7 |
| P51 | 1800 | 1600 | 14.11 | 13.97 | 2309 | 6.6 |
| P41 | 1800 | 1600 | 14.18 | 14.63 | 2321 | 6.5 |
| P63 | 2000 | | 14.31 | 14.37 | 2557 | 7.9 |
| P19 | 1700 | | 14.11 | 14.11 | 2059 | 7.6 |
| P19 | 1700 | 1600 | 14.11 | | 2012 | 8.0 |
| P20 | 1725 | | 14.35 | 14.52 | 2221 | 6.4 |
| P20 | 1725 | 1600 | 14.35 | 14.35 | 2151 | 7.0 |
| P67 | 2200 | | 14.65 | 14.21 | 2113 | 8.1 |
| P67 | 2200 | 1725 | 14.65 | 14.34 | 2210 | 7.1 |

Another example under the fourth category uses a Ni-based superalloy plus Re and Co as binder which is also about 5% to 40% by volume. Exemplary compositions of hardmetals bound by Ni-based superalloy plus Re and Co are list in TABLE 10.

TABLE 10

Composition of hardmetals bound by Ni-based superalloy plus Re and Co

| | Composition, weight % | | | | | | |
|---|---|---|---|---|---|---|---|
| | Re | Co | Rene95 | U-720 | U-700 | WC | VC |
| P73 | 1.8 | 4.8 | 2.7 | | | 90.4 | 0.3 |
| P74 | 1.8 | 3 | 4.5 | | | 90.4. | 0.3 |
| P75 | 0.8 | 3 | 4.5 | | | 91.4 | 0.3 |
| P76 | 0.8 | 3 | | 4.5 | | 91.4 | 0.3 |
| P77 | 0.8 | 3 | | | 4.5 | 91.4 | 0.3 |

TABLE 10-continued

Composition of hardmetals bound by Ni-based superalloy plus Re and Co

| | Composition, weight % | | | | | | |
|---|---|---|---|---|---|---|---|
| | Re | Co | Rene95 | U-720 | U-700 | WC | VC |
| P78 | 0.8 | 4.5 | | 3 | | 91.4 | 0.3 |
| P79 | 0.8 | 4.5 | | | 3.1 | 91.3 | 0.3 |

Measurements on selected samples have been performed to study properties of the binder matrices with Ni-based superalloys. In general, Ni-based superalloys not only exhibit excellent strengths at elevated temperatures but also possess outstanding resistances to oxidation and corrosion at high temperatures. Ni-based superalloys have complex microstructures and strengthening mechanisms. In general, the strengthening of Ni-based superalloys is primarily due to precipitation strengthening of γ-γ' and solid-solution strengthening. The measurements the selected samples demonstrate that Ni-based superalloys can be used as a high-performance binder materials for hardmetals.

TABLE 11 lists compositions of selected samples by their weight percentages of the total weight of the hardmetals. The WC particles in the samples are 0.2 μm in size. TABLE 12 lists the conditions for the two-step process performed and measured densities, hardness parameters, and toughness parameters of the samples. The Palmqvist fracture toughness Ksc is calculated from the total crack length of Palmqvist crack which is produced by the Vicker Indentor: $Ksc=0.087*(Hv*W)^{1/2}$. See, e.g., Warren and H. Matzke, Proceedings Of the International Conference On the Science of Hard Materials, Jackson, Wyo., Aug. 23-28, 1981. Hardness Hv and Crack Length are measured at a load of 10 Kg for 15 seconds. During each measurement, eight indentations were made on each specimen and the average value was used in computation of the listed data.

TABLE 11

| | Weight % | | | | | | |
|---|---|---|---|---|---|---|---|
| | Re | Co | R-95 | WC | VC | Re in Binder | Vol % Binder |
| P54 | 0 | 8 | 0 | 91.4 | 0.6 | 0 | 13.13 |
| P58 | 0 | 0 | 7.5 | 91.9 | 0.6 | 0 | 13.25 |
| P56 | 1.8 | 7.2 | 0 | 90.4 | 0.6 | 20 | 13.20 |
| P72 | 1.8 | 7.2 | 0 | 90.7 | 0.3 | 20 | 13.18 |
| P73 | 1.8 | 4.8 | 2.7 | 90.4 | 0.3 | 20 | 14.00 |
| P74 | 1.8 | 3 | 4.5 | 90.4 | 0.3 | 20 | 14.24 |

Measurements on selected samples have also been performed to further study properties of the binder matrices with Re in the binder matrices. TABLE 13 lists the tested samples. The WC particles with two different particle sizes of 2 μm and 0.2 μm were used. TABLE 14 lists the conditions for the two-step process performed and the measured densities, hardness parameters, and toughness parameters of the selected samples.

TABLE 12

| Sample Code | Sinter Condition | HIP Condition | Cal. Density g/c.c. | Measu. Density g/c.c. | Hardness, HV Kg/mm$^2$ | Palmqvist Toughness Ksc, $\times 10^6$ Pa · m$^{1/2}$ |
|---|---|---|---|---|---|---|
| P54-5 | 1360° C./1 hr | | 14.63 | 14.58 | 2062 ± 35 | 8.9 ± 0.2 |
| | 1360° C./1 hr | 1305° C./15 KSI/1 hr | | 14.55 | 2090 ± 22 | 8.5 ± 0.2 |
| P58-7 | 1550° C./1 hr | | 14.50 | 14.40 | 2064 ± 12 | 7.9 ± 0.2 |
| | 1550° C./1 hr | 1305° C./15 KSI/1 hr | | 14.49 | 2246 ± 23 | 7.3 ± 0.1 |
| P56-5 | 1360° C./1 hr | | 14.77 | 14.71 | 2064 ± 23 | 8.2 ± 0.1 |
| | 1360° C./1 hr | 1305° C./15 KSI/1 hr | | 14.72 | 2133 ± 34 | 8.6 ± 0.2 |
| P72-6 | 1475° C./1 hr | | 14.83 | 14.77 | 2036 ± 34 | 8.5 ± 0.6 |
| | 1475° C./1 hr | 1305° C./15 KSI/1 hr | | 14.91 | 2041 ± 30 | 9.1 ± 0.4 |
| P73-6 | 1475° C./1 hr | | 14.73 | 14.70 | 2195 ± 23 | 7.7 ± 0.1 |
| | 1475° C./1 hr | 1305° C./15 KSI/1 hr | | 14.72 | 2217 ± 25 | 8.1 ± 0.2 |
| P74-5 | 1500° C./1 hr and 1520° C./1 hr | | 14.69 | 14.69 | 2173 ± 30 | 7.4 ± 0.3 |
| | 1500° C./1 hr and 1520° C./1 hr | 1305° C./15 KSI/1 hr | | 14.74 | 2223 ± 34 | 7.7 ± 0.1 |

Among the tested samples, the sample P54 uses the conventional binder consisting of Co. The Ni-superalloy R-95 is used in the sample P58 to replace Co as the binder in the sample P54. As a result, the Hv increases from 2090 of P54 to 2246 of P58. In the sample P56, the mixture of Re and Co is used to replace Co as binder and the corresponding Hv increases from 2090 of P54 to 2133 of P56. The samples P72, P73, P74 have the same Re content but different amounts of Co and R95. The mixtures of Re, Co, and R95 are used in samples P73 and P74 to replace the binder having a mixture of Re and Co as the binder in the sample 72. The hardness Hv increases from 2041(P72) to 2217 (P73) and 2223(P74).

TABLE 13

| | Weight % | | | | | | | | |
|---|---|---|---|---|---|---|---|---|---|
| | Re | R-95 | Co | TiC | TaC | WC (2 μm) | WC (0.2 μm) | Re in Binder | Vol. % Binder |
| P17 | 1.5 | 4.5 | 0 | 3 | 3 | 88 | 0 | 25 | 8.78 |
| P18 | 3 | 3 | 0 | 3 | 3 | 88 | 0 | 50 | 7.31 |
| P25 | 3.75 | 2.25 | 0 | 3 | 3 | 88 | 0 | 62.5 | 6.57 |
| P48 | 3.75 | 2.25 | 0 | 5 | 5 | 84 | 0 | 62.5 | 6.3 |
| P50 | 4.83 | 1.89 | 0 | 5.31 | 5.22 | 82.75 | 0 | 71.9 | 6.4 |
| P51 | 7.15 | 0.93 | 0 | 5.23 | 5.14 | 81.55 | 0 | 88.5 | 6.4 |
| P49 | 7.55 | 0 | 3.25 | 5.31 | 5.21 | 78.68 | 0 | 69.9 | 10 |
| P40A | 7.57 | 2.96 | 0 | 5.32 | 5.23 | 78.92 | 0 | 71.9 | 10 |
| P63 | 12.47 | 0.86 | 0 | 5.16 | 5.07 | 0 | 76.45 | 93.6 | 10 |
| P62A | 14.48 | 0 | 0 | 5.09 | 5.00 | 0 | 75.43 | 100 | 10 |
| P66 | 27.92 | 0 | 0 | 4.91 | 4.82 | 0 | 62.35 | 100 | 20 |

TABLE 14

| Sample Code | Sinter Condition | HIP Condition | Cal. Density g/c.c. | Measu. Density g/c.c. | Hardness, Hv Kg/mm$^2$ | Palmqvist Toughness** Ksc, MPam$^{0.5}$ |
|---|---|---|---|---|---|---|
| P17-5 | 1800° C./1 hr | 1600° C./15 KSI/1 hr | 14.15 | 14.21 | 2092 ± 3 | 7.2 ± 0.1 |
| P18-3 | 1800° C./1 hr | 1600° C./15 KSI/1 hr | 14.38 | 14.59 | 2028 ± 88 | 6.8 ± 0.3 |
| P25-3 | 1750° C./1 hr | 1600° C./15 KSI/1 hr | 14.49 | 14.48 | 2193 ± 8 | 6.5 ± 0.1 |
| P48-1 | 1800° C./1 hr | 1600° C./15 KSI/1 hr | 13.91 | 13.99 | 2208 ± 12 | 6.3 ± 0.4 |
| P50-4 | 1800° C./1 hr | 1600° C./15 KSI/1 hr | 13.9 | 13.8 | 2294 ± 20 | 6.3 ± 0.1 |
| P51-1 | 1800° C./1 hr | 1600° C./15 KSI/1 hr | 14.11 | 13.97 | 2309 ± 6 | 6.6 ± 0.1 |
| P40A-1 | 1800° C./1 hr | 1600° C./15 KSI/1 hr | 13.86 | 13.86 | 2321 ± 10 | 6.3 ± 0.1 |
| P49-1 | 1800° C./1 hr | 1600° C./15 KSI/1 hr | 13.91 | 13.92 | 2186 ± 29 | 6.5 ± 0.2 |
| P62A-6 | 2200° C./1 hr | 1725° C./30 KSI/1 hr | 14.5 | 14.41 | 2688 ± 22 | 6.7 ± 0.1 |
| P63-5 | 2200° C./1 hr | 1725° C./30 KSI/1 hr | 14.31 | 14.37 | 2562 ± 31 | 6.7 ± 0.2 |
| P66-4 | 2200° C./1 hr | | 15.04 | 14.40 | 2402 ± 44 | 8.2 ± 0.4 |
| P66-4 | 2200° C./1 hr | 1725° C./30 KSI/1 hr | 15.04 | 14.52 | | |
| P66-4 | 2200° C./1 hr | 1725° C./30 KSI/1 hr + 1950° C./30 KSI/1 hr | 15.04 | 14.53 | 2438 ± 47 | 6.9 ± 0.2 |
| P66-5 | 2200° C./1 hr | | 15.04 | 14.33 | 2092 ± 23 | 7.3 ± 0.3 |
| P66-5 | 2200° C./1 hr | 1725° C./30 KSI/1 hr | 15.04 | 14.63 | | |
| P66-5 | 2200° C./1 hr | 1725° C./30 KSI/1 hr + 1850° C./30 KSI/1 hr | 15.04 | 14.66 | 2207 ± 17 | 7.1 ± 0.2 |

TABLE 15 further shows measured hardness parameters under various temperatures for the selected samples, where the Knoop hardness $H_k$ were measured under a load of 1 Kg for 15 seconds on a Nikon QM hot hardness tester and R is a ratio of $H_k$ at an elevated testing temperature over $H_k$ at 25° C. The hot hardness specimens of C2 and C6 carbides were prepared from inserts SNU434 which were purchased from MSC Co. (Melville, N.Y.).

solid-phase sintering process. Hot hardness values of such hardmetals with Re in the binders (e.g., P17 to P63) are much higher than conventional Co bound hardmetals (C2 and C6 carbides). In particular, the above measurements reveal that an increase in the concentration of Re in the binder increases the hardness at high temperatures. Among the tested samples, the sample P62A with pure Re as the binder has the highest hardness. The sample P63 with a

TABLE 15

(each measured value at a given temperature is an averaged value of 3 different measurements)

| Lot No. | | Testing Temperature, ° C. 25 | 400 | 500 | 600 | 700 | 800 | 900 | Hv @25° |
|---|---|---|---|---|---|---|---|---|---|
| P17-5 | Hk, Kg/mm$^2$ | 1880 ± 10 | | 1720 ± 17 | 1653 ± 25 | 1553 ± 29 | 1527 ± 6 | | 2092 ± 3 |
| | R, % | 100 | | 91 | 88 | 83 | 81 | | |
| P18-3 | Hk, Kg/mm$^2$ | 1773 ± 32 | | 1513 ± 12 | 1467 ± 21 | 1440 ± 10 | 1340 ± 16 | | 2028 ± 88 |
| | R, % | 100 | | 85 | 83 | 81 | 76 | | |
| P25-3 | Hk, Kg/mm$^2$ | 1968 ± 45 | | 1813 ± 12 | | 1710 ± 0 | | 1593 ± 5 | 2193 ± 8 |
| | R, % | 100 | | 92 | | 87 | | 81 | |
| P40A-1 | Hk, Kg/mm$^2$ | 2000 ± 35 | | 1700 ± 17 | 1663 ± 12 | 1583 ± 21 | 1540 ± 35 | | 2321 ± 10 |
| | R, % | 100 | | 85 | 83 | 79 | 77 | | |
| P48-1 | Hk, Kg/mm$^2$ | 1925 ± 25 | | 1613 ± 15 | 1533 ± 29 | 1477 ± 6 | 1377 ± 15 | | 2208 ± 12 |
| | R, % | 100 | | 84 | 80 | 77 | 72 | | |
| P49-1 | Hk, Kg/mm$^2$ | 2023 ± 32 | | 1750 ± 0 | 1633 ± 6 | 1600 ± 17 | | | 2186 ± 29 |
| | R, % | 100 | | 87 | 81 | 79 | | | |
| P50-4 | Hk, Kg/mm$^2$ | 2057 ± 25 | | 1857 ± 15 | 1780 ± 20 | 1713 ± 6 | 1627 ± 40 | | 2294 ± 20 |
| | R, % | 100 | | 90 | 87 | 83 | 79 | | |
| P51-1 | Hk, Kg/mm$^2$ | 2050 ± 26 | | 1797 ± 6 | 1743 ± 35 | 1693 ± 15 | 1607 ± 15 | | 2309 ± 6 |
| | R, % | 100 | | 88 | 85 | 83 | 78 | | |
| P62A-6 | Hk, Kg/mm$^2$ | 2228 ± 29 | | 2063 ± 25 | | 1960 ± 76 | | 1750 ± 0 | 2688 ± 22 |
| | R, % | 100 | | 93 | | 88 | | 79 | |
| P63-5 | Hk, Kg/mm$^2$ | 1887 ± 6 | | 1707 ± 35 | 1667 ± 15 | 1633 ± 6 | 1603 ± 25 | | 2562 ± 31 |
| | R, % | 100 | | | | | | | |
| C2 Carbide | Hk, Kg/mm$^2$ | 1503 ± 38 | 988 ± 9 | 711 ± 0 | 584 ± 27 | | | | 1685 ± 16 |
| | R, % | 100 | 66 | 47 | 39 | | | | |
| C6 Carbide | Hk, Kg/mm$^2$ | 1423 ± 23 | | 1127 ± 25 | 1090 ± 10 | 1033 ± 23 | 928 ± 18 | | 1576 ± 11 |
| | R, % | 100 | | 79 | 77 | 73 | 65 | | |

The inclusion of Re in the binder matrices of the hardmetals increases the melting point of binder alloys that include Co—Re, Ni superalloy-Re, Ni superalloy-Re—Co. For example, the melting point of the sample P63 is much higher than the temperature of 2200° C. used for the binder composition of 94% of Re and 6% of the Ni-based superalloy R95 has the second highest hardness. The samples P40A (71.9% Re-29.1% R95), P49 (69.9% Re-30.1% R95), P51 (88.5% Re-11.5% R95), and P50 (71.9% Re-28.1% R95) are the next group in their hardness.

The sample P48 with 62.5% of Re and 37.5% of R95 in its binder has the lowest hardness at high temperatures among the tested materials in part because its Re content is the lowest.

In yet another category, a hardmetal or cermet may include TiC and TiN bonded in a binder matrix having Ni and Mo or $MO_2C$. The binder Ni of cermet can be fully or partially replaced by Re, by Re plus Co, by Ni-based superalloy, by Re plus Ni-based superalloy, and by Re plus Co and Ni-based superalloy. For example, P38 and P39 are a typical Ni bound cermet. The sample P34 is Rene95 bound Cermet. The P35, P36, P37, and P45 are Re plus Rene95 bound cermet. Compositions of P34, 35, 36, 37, 38, 39, and 45 are list in TABLE 16.

TABLE 16

Composition of P34 to P39

| | Weight % | | | | | | | |
|---|---|---|---|---|---|---|---|---|
| | Re | Rene95 | Ni 1 | Ni 2 | TiC | $Mo_2C$ | WC | TaC |
| P34 | | 14.47 | | | 69.44 | 16.09 | | |
| P35 | 8.77 | 10.27 | | | 65.37 | 15.23 | | |
| P36 | 16.6 | 6.50 | | | 62.40 | 14.46 | | |
| P37 | 23.8 | 3.09 | | | 59.38 | 13.76 | | |
| P38 | | | 15.51 | | 68.60 | 15.89 | | |
| P39 | | | | 15.51 | 68.60 | 15.89 | | |
| P45 | 9.37 | 3.66 | | | 15.37 | 6.51 | 58.6 | 6.47 |

The above compositions for hardmetals or cermets may be used for a variety of applications. For example, such a material may be used to form a wear part in a tool that cuts, grinds, or drills a target object by using the wear part to remove the material of the target object. Such a tool may include a support part made of a different material, such as a steel. The wear part is then engaged to the support part as an insert. The tool may be designed to include multiple inserts engaged to the support part. For example, some mining drills may include multiple button bits made of a hardmetal material. Examples of such a tool includes a drill, a cutter such as a knife, a saw, a grinder, a drill. Alternatively, hardmetals descried here may be used to form the entire head of a tool as the wear part for cutting, drilling or other machining operations. The hardmetal particles may also be used to form abrasive grits for polishing or grinding various materials. In addition, such hardmetals may also be used to construct housing and exterior surfaces or layers for various devices to meet specific needs of the operations of the devices or the environmental conditions under which the devices operate.

More specifically, the hardmetals described here may be used to manufacture cutting tools for machining of metal, composite, plastic and wood. The cutting tools may include indexable inserts for turning, milling, boring and drilling, drills, end mills, reamers, taps, hobs and milling cutters. Since the temperature of the cutting edge of such tools may be higher than 500° C. during machining, the hardmetal compositions for high-temperature operating conditions described above may have special advantages when used in such cutting tools, e.g., extended tool life and improved productivity by such tools by increasing the cutting speed.

The hardmetals described here may be used to manufacture tools for wire drawing, extrusion, forging and cold heading. Also as mold and Punch for powder process. In addition, such hardmetals may be used as wear-resistant material for rock drilling and mining.

Only a few implementations and examples are disclosed. However, it is understood that variations and enhancements may be made without departing from the spirit of and are intended to be encompassed by the following claims.

What is claimed is:

1. A method comprising:

forming a grade power by mixing a powder of hard particles with a binder matrix material comprising rhenium; and processing the grade powder to use the binder matrix material to bind the hard particles to produce a solid hardmetal material, wherein the processing includes (1) sintering the grade powder in a solid phase under a vacuum condition at a temperature below an eutectic temperature of the hard particles and the binder matrix material to remove or eliminate interconnected porosity and to solidify the grade powder, and (2) subsequently sintering the solidified grade powder in a solid phase under a pressure in an inert gas medium and below the eutectic temperature to produce a densified material without further performing a rapid omnidirectional compaction (ROC) process.

2. The method as in claim 1, wherein the hard particles are ultra fine hard particles with a particulate dimension of several microns.

3. The method as in claim 2, wherein the ultra fine hard particles have a particulate dimension less than 0.5 micron.

4. A method comprising:

forming a grade power by mixing a powder of hard particles with a binder matrix material comprising rhenium; and processing the grade powder to use the binder matrix material to bind the hard particles to produce a solid hardmetal material, wherein the processing includes (1) sintering the grade powder in a solid phase under a vacuum condition to reduce porosity and to solidify the grade powder, and (2) subsequently sintering the solidified grade powder in a solid phase under a pressure in an inert gas medium, wherein the binder matrix material further includes a Ni-based superalloy.

5. The method as in claim 4, wherein the binder matrix material further includes cobalt.

6. The method as in claim 4, wherein:

the sintering in the solid phase under the vacuum condition is controlled to be at a temperature below an eutectic temperature of the hard particles and the binder matrix material and to remove or eliminate interconnected porosity prior to the subsequent sintering, and the subsequent sintering in the inert gas medium is controlled to produce a densified material without further performing a rapid omnidirectional compaction (ROC) process.

7. The method as in claim 6, wherein the hard particles are ultra fine hard particles with a particulate dimension of several microns.

8. The method as in claim 7, wherein the ultra fine hard particles have a particulate dimension less than 0.5 micron.

9. A method comprising:

forming a grade power by mixing a powder of hard particles with a binder matrix material comprising rhenium; and processing the grade powder to use the binder matrix material to bind the hard particles to produce a solid hardmetal material, wherein the processing includes (1) sintering the grade powder in a solid phase under a vacuum condition to reduce porosity and to solidify the grade powder, and (2) subsequently sintering the solidified grade powder in a solid phase under a pressure in an inert gas medium, wherein the binder matrix material further includes cobalt.

10. The method as in claim 9, wherein:

the sintering in the solid phase is controlled to be at a temperature below an eutectic temperature of the hard particles and the binder matrix material and to remove or eliminate interconnected porosity prior to the subsequent sintering, and the subsequent sintering is controlled to produce a densified material without further performing a rapid omnidirectional compaction (ROC) process.

11. The method as in claim 10, wherein the hard particles are ultra fine hard particles with a particulate dimension of several microns.

12. The method as in claim 11, wherein the ultra fine hard particles have a particulate dimension less than 0.5 micron.

13. A method comprising:

forming a grade powder by mixing a powder of hard particles with a binder matrix material comprising a nickel-based superalloy;

sintering the grade powder in a solid state phase under a vacuum condition at a temperature below an eutectic temperature of the hard particles and the binder matrix material to remove or eliminate interconnected porosity to produce a solid hardmetal material from the grade powder, wherein the binder matrix material binds the hard particles in the solid hardmetal material; and subsequently sintering the solid hardmetal material in a solid phase under a pressure in an inert gas medium and below the eutectic temperature to produce a densified material without further performing a rapid omnidirectional compaction (ROC) process.

14. The method as in claim 13, wherein the subsequent solid phase sintering is a hot isostatic pressing process.

15. The method as in claim 13, wherein the hard particles are ultra fine hard particles with a particulate dimension of several microns.

16. The method as in claim 15, wherein the ultra fine hard particles have a particulate dimension less than 0.5 micron.

17. A method, comprising:

forming a grade powder by mixing a powder of hard particles with a binder matrix material comprising a nickel-based superalloy;

processing the grade powder to produce a solid hardmetal material by using the binder matrix material to bind the hard particles, wherein said processing includes sequentially performing a pressing operation, a first sintering operation, a shaping operation, and a second sintering operation, wherein the first sintering operation is performed under a vacuum condition and is controlled to be at a temperature below an eutectic temperature of the hard particles and the binder matrix material in a solid state to remove or eliminate interconnected porosity, and the second sintering operation is controlled to produce a densified material without further performing a rapid omnidirectional compaction (ROC) process.

18. The method as in claim 17, further comprising: prior to the mixing, preparing the binder matrix material to further include rhenium.

19. The method as in claim 17, further comprising: prior to the mixing, preparing the binder matrix material to further include cobalt.

20. The method as in claim 17, wherein the hard particles are ultra fine hard particles with a particulate dimension of several microns.

21. The method as in claim 20, wherein the ultra fine hard particles have a particulate dimension less than 0.5 micron.

22. A method, comprising:

forming a grade powder by mixing a powder of hard particles with a binder matrix material comprising a nickel-based superalloy;

processing the grade powder to produce a solid hardmetal material by using the binder matrix material to bind the hard particles, wherein the processing includes (1) sintering the grade powder in a solid phase under a vacuum condition to produce a solidified grade powder, and (2) sintering the solidified grade power in a solid phase under a pressure in an inert gas medium.

23. The method as in claim 22, further comprising: prior to the mixing, preparing the hard particles with a particle dimension less than 0.5 micron to reduce a temperature of the sintering operations.

24. The method as in claim 22, further comprising: prior to the mixing, preparing the binder matrix material to further include rhenium.

25. The method as in claim 22, further comprising: prior to the mixing, preparing the binder matrix material to further include cobalt.

26. The method as in claim 22, wherein the hard particles comprise a carbide.

27. The method as in claim 26, wherein said carbide comprises at least one of tungsten carbide, titanium carbide, tantalum carbide, niobium carbide, vanadium carbide, chromium carbide, hafnium carbide, and molybdenum carbide.

28. The method as in claim 27, wherein the hard particles further comprise a nitride.

29. The method as in claim 26, wherein the hard particles further comprise a nitride.

30. The method as in claim 22, wherein the hard particles further comprise a nitride.

31. The method as in claim 30, wherein the nitride comprises at least one of TiN and HfN.

32. The method as in claim 22, wherein:

the sintering in the solid phase under the vacuum condition is controlled to be at a temperature below an eutectic temperature of the hard particles and the binder matrix material to remove or eliminate interconnected porosity prior to the subsequent sintering, and the subsequent sintering in the solid state in the inert gas medium is controlled to produce a densified material without further performing a rapid omnidirectional compaction (ROC) process.

33. The method as in claim 32, wherein the hard particles are ultra fine hard particles with a particulate dimension of several microns.

34. The method as in claim 33, wherein the ultra fine hard particles have a particulate dimension less than 0.5 micron.

* * * * *